US010933465B2

(12) United States Patent
Hetke

(10) Patent No.: US 10,933,465 B2
(45) Date of Patent: Mar. 2, 2021

(54) CASTING SYSTEM

(71) Applicant: Adolf Hetke, Brooklyn, MI (US)

(72) Inventor: Adolf Hetke, Brooklyn, MI (US)

( * ) Notice: Subject to any disclaimer, the term of this patent is extended or adjusted under 35 U.S.C. 154(b) by 0 days.

(21) Appl. No.: 16/456,201

(22) Filed: Jun. 28, 2019

(65) Prior Publication Data

US 2019/0344335 A1 Nov. 14, 2019

Related U.S. Application Data

(63) Continuation-in-part of application No. 15/976,305, filed on May 10, 2018.

(51) Int. Cl.

| | |
|---|---|
| ***B22D 18/04*** | (2006.01) |
| ***B22D 17/32*** | (2006.01) |
| ***B22D 39/02*** | (2006.01) |
| ***B22D 17/22*** | (2006.01) |
| ***B22D 17/30*** | (2006.01) |
| ***B22D 27/00*** | (2006.01) |

(52) U.S. Cl.

CPC ..... *B22D 18/04* (2013.01); *B22D 17/22* (2013.01); *B22D 17/30* (2013.01); *B22D 17/32* (2013.01); *B22D 27/003* (2013.01); *B22D 39/02* (2013.01)

(58) Field of Classification Search

CPC ..... B22D 18/04; B22D 17/22; B22D 17/30; B22D 17/32; B22D 27/003; B22D 39/02

See application file for complete search history.

(56) References Cited

U.S. PATENT DOCUMENTS

| | | | | |
|---|---|---|---|---|
| 3,823,760 A * | 7/1974 | Bloomfield | B22D 18/04 164/113 |
| 4,633,930 A * | 1/1987 | Behrens | B22D 17/30 164/113 |
| 4,938,274 A * | 7/1990 | Iwamoto | B22D 17/145 164/4.1 |
| 5,163,500 A * | 11/1992 | Seaton | B22D 18/04 164/119 |
| 6,247,521 B1 * | 6/2001 | Kawai | B22D 18/04 164/119 |
| 6,932,146 B2 * | 8/2005 | Nichol | B22D 18/04 164/306 |

(Continued)

FOREIGN PATENT DOCUMENTS

| | | |
|---|---|---|
| JP | 61209761 A * | 9/1986 |
| JP | H09314318 A | 12/1997 |

(Continued)

OTHER PUBLICATIONS

International Search Report of PCT/US2019/030839.

*Primary Examiner* — Kevin P Kerns
*Assistant Examiner* — Steven S Ha
(74) *Attorney, Agent, or Firm* — Fishman Stewart PLLC

(57) ABSTRACT

A foundry casting system and process employs an inert gas delivery and recovery system for casting parts which results in cast parts having improved metalurgical characteristics. The system may be employed in sand, die casting, semi-permanent and permanent casting environments. Pressurized inert gas may be diffused into the mold before, during and after the metal pouring step. The resulting casting is free from oxides and dissolved hydrogen gas as they are removed from the mold cavity. This results in higher quality castings as well as increased production output due to faster cooling cycles.

20 Claims, 20 Drawing Sheets

(56) References Cited

U.S. PATENT DOCUMENTS

| | | | | |
|---|---|---|---|---|
| 7,896,059 | B2 | 3/2011 | Hetke | |
| 2001/0002617 | A1* | 6/2001 | Schofield | B22D 17/14 164/61 |
| 2003/0056929 | A1* | 3/2003 | Staley, Jr. | B22D 17/14 164/61 |
| 2005/0126740 | A1* | 6/2005 | Wust | B22D 17/14 164/457 |
| 2008/0264597 | A1* | 10/2008 | Harada | B22D 17/145 164/271 |
| 2008/0308249 | A1 | 12/2008 | Hetke | |

FOREIGN PATENT DOCUMENTS

| | | | |
|---|---|---|---|
| JP | 2011192544 | A | 9/2011 |
| JP | H-11192544 | A | 9/2011 |
| JP | 2018/065168 | A | 4/2018 |
| WO | WO-2007/079482 | A2 | 7/2007 |
| WO | WO-2017/085765 | A1 | 5/2017 |

* cited by examiner

1075

| MOLD # | A | A | A | A |
|---|---|---|---|---|
| SAMPLE # | 1 | 2 | 3 | 4 |
| ATMOSPHERE | AIR | AIR | HELIUM | HELIUM |
| TEMP @ FURNACE | 710 C | 710 C | 710 C | 710 C |
| TENSIL STRENGTH | 175 Mpa | 166 Mpa | 183 Mpa | 183 Mpa |
| YIELD PROOF STRENGTH = STRENGTH | 92 Mpa | 91 Mpa | 92 Mpa | 89 Mpa |
| ELONGATION % | 7.5 | 5.5 | 10 | 14 |
| DAS μ | 30 | | | 25 |
| COOLING RATE */sec | 0.82 | 0.82 | 0.92 | 0.92 |

FIG. 19

1080

| THERMAL FATIGUE LIFE CYCLES | DAS μ | VOLUME % POROSITY |
|---|---|---|
| 1286 | 16 | 0.77 |
| | | |
| 1183 | 25 | 0.16 |
| 1180 | 36 | 0.75 |
| 1112 | 25 | 0.55 |
| | | |
| 464 | 41 | 4.88 |
| 436 | 43 | 2.38 |
| 326 | 51 | 2.02 |
| 194 | 39 | 2.78 |
| | | |

BEST

PERFORMANCE

WORST

FIG. 20

CASTING SYSTEM

CROSS-REFERENCE TO RELATED APPLICATION

This application claims priority to U.S. patent application Ser. No. 15/976,305 filed May 10, 2018 and is hereby incorporated by reference in its entirety.

BACKGROUND

The automotive and aerospace industries continue to drive innovation in a variety of technological fields, including that of the cast metals industry. Continual market pressure to significantly reduce cast component cost through productivity and weight reduction while increasing performance has highlighted the need for geometric design flexibility and the merging of value-added features into complex engineered castings. This focus gave birth to high volume precision sand casting ("PSC") for aluminum engine blocks and cylinder heads. Dry sand molding combined with sand core technology for intricate internal casting features a practical and flexible approach for "Core-Pack Molding" in the production of aluminum castings. This technology is cost effective and complex-design friendly for a high-volume production foundry process. PSC technology is being utilized for the production of premium quality aluminum engine blocks in direct competition with die cast/permanent mold casting technology for the North American automotive industry.

The automotive industry is continuously demanding reduction of vehicle weight, coupled with significant reduction in overall manufacturing product and process costs. There is a need to address this pressing demand for weight and cost reduction, for example, in engine block and powertrain components. Die casting (DC) and low-pressure permanent mold filling technologies could be enhanced by unique mold environment features to achieve cost reduction and premium quality aluminum metallurgy.

The manufacturing industry is also demanding an improved casting process that can be used in low to medium volume production facilities. For example, in the foundry environment, there is a demand to provide a casting system that is flexible for small production runs to generate prototype sample parts. There is also a demand to then utilize that same production process for larger scale production runs as well. Thus, a flexible casting process that is operable for prototype runs as well as production runs is in demand. Cost savings can result from such an improved casting system.

OVERVIEW

The present disclosure contemplates a casting system and process employing high pressure die casting and/or low-pressure permanent mold casting process. Using a counter-gravity molten metal delivery system, a low-pressure furnace delivers premium quality molten lightweight material, such as aluminum, that is free from oxides and dissolved hydrogen gas into the mold cavity. A high-pressure metal delivery system in the die casting process utilizes a plunger that forced air out of the mold/die cavity via numerous strategically located air vents.

To make the mold cavity free from oxides and provide a high heat transfer layer between the mold surface and the molten aluminum entering the mold cavity, an inert gas, such as but not limited to helium gas (He), is deployed which facilitates rapid solidification of the molten aluminum, thus influencing very fine metallurgical dendrite formation. A gas delivery and control system may work in connection with a CPU of a casting system to manage gas delivery. The inert gas is strategically introduced into the mold/die cavity through a gas piping system that is similar system to the air venting system and it is located particularly for the purpose of introducing helium gas. The cavity may be flushed with He prior to the metal being introduced into the cavity. The metallurgical impact on the aluminum is reflected in measurable [between 50% and 100%] mechanical property improvements. Vent plugs may be deployed to help diffuse inert gas into the cavity of the mold. Because casting solidification is enhanced significantly due to the helium cooling effect, production cycle time is reduced accordingly and thus productivity output is enhanced measurably.

The die cast mold and/or permanent mold construction provides for helium venting passages that are strategically located in casting cavity areas in order to enhance solidification properties. He gas, because of its unique qualities of thermal conductivity [six times that of air], significantly improves the efficiency of the heat transfer of the molten metal, such as aluminum, that is in contact with mold cavity areas. Further, the He gas can be introduced into the mold via a targeted helium vent system that specifically targets the mold cavity for maximum effectiveness in order to achieve the desired mechanical and physical properties.

This disclosure provides at least two improved hard mold tooling [iron and steel] configurations that take advantage of the He cooling gas environment. They are:

1. An improved high pressure die casting (DC) process that is designed to provide a high productivity production casting process. A plunger metal delivery system forces air in the steel mold cavity out of the mold and fill cavity prior to full solidification. Because the air is a high density media, evacuation is not nearly as rapid as desired. Thus, helium or another inert gas is deployed to occupy the mold cavities. Helium gas facilitates rapid mold cavity air evacuation as well as enhanced rapid solidification resulting premium quality castings. As a result, entrapped air is forced out. The resulting heat transfer between molten aluminum and the steel die surface is accelerated and thus results in sound porosity free aluminum castings that are produced at faster cycle rates.
2. An improved permanent mold (PM) and semi-permanent mold (SPM) casting process is also disclosed to provide a high-volume production casting process. A distinction between the PM and SPM casting process and the DC process is the metal delivery system. In DC the metal is delivered under high pressure via plunger as opposed to PM and SPM the metal delivery can be by gravity pouring into the mold and/or low-pressure counter gravity delivery into the mold cavity. In either case, helium gas is flushed through the mold cavity prior to the mold filling step and during the mold solidifying step which is part of the dendrite formation stage. The resulting castings have improved mechanical properties and the foundry process has improved mold cycle rates. Casting thin wall capabilities are further enhanced and are now made possible because the air evacuation issues are now mitigated by the introduction of an inert gas.

BRIEF DESCRIPTION OF THE DRAWINGS

FIG. 19 is a comparison chart showing performance results of a sand mold aluminum casting trial where castings having been cooled by air (see columns 1 and 1) have been compared to castings having been cooled by an inert gas (see columns 3 and 4) such as Helium; and FIG. 20 is a chart showing performance results of a permanent mold casting trial that deployed water as a source to cool molds, wherein Dendrite Arm Spacing (DAS) is shown to positively influence the volume percent of porosity and thermal fatigue life of a casting.

DETAILED DESCRIPTION OF THE DISCLOSURE

Figure 1:
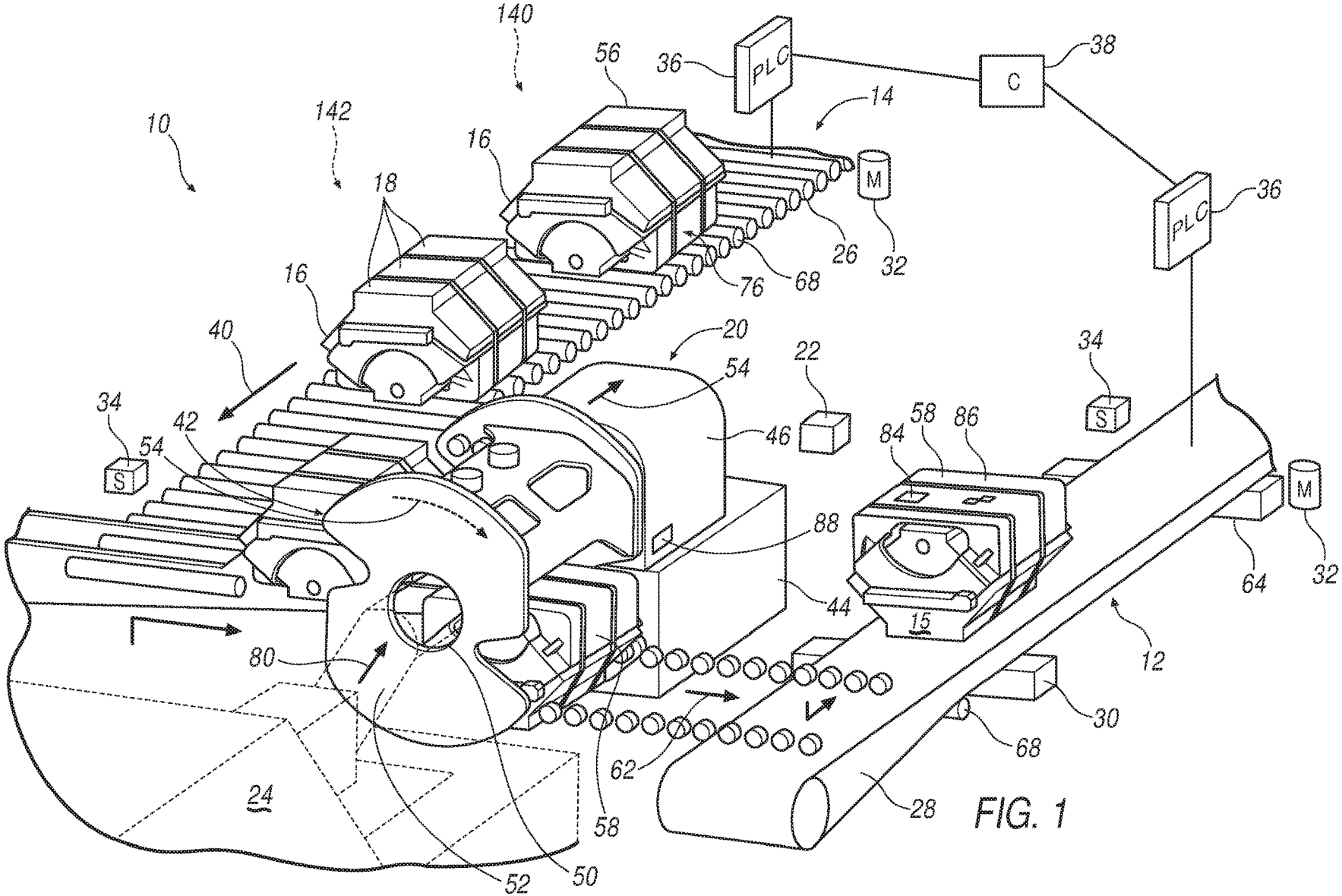
FIG. 1 is a schematic diagram of a casting system for manufacturing metal castings, showing a mold being loaded in to a roll-over system.

A casting system 10 can be deployed in a foundry prototype or hi-production facility where sand casting, die casting, permanent mold and semi-permanent mold casting process very thin, lightweight sand cores for Core-Pack Molding can be used in the production of light metal castings such as, but not limited to, aluminum and magnesium. The lightweight sand cores are produced with conventional machines and core sand binder systems. One improvement is in the assembly of the lightweight core segments with shape specific geometries into a core pack, and subsequently shrink-wrapped, to form a seal of the core pack to keep the assembly intact dimensionally while being counter-gravity filled with molten aluminum. The improved lightweight core pack can also be supported within a fixture and then sealed via shrink wrap, or some other method, to achieve a self-contained mold environment that can be flushed with an inert cooling gas, such as, but not limited to, Helium, to significantly improve the molten metal and mold heat transfer characteristics. In addition to keeping the core pack assembly intact, the shrink wrap and/or other techniques create a self-contained environment that can be designed to allow for a vacuum attachment that will draw a vacuum on the mold cavity while being filled with molten metal. The slight vacuum will facilitate the removal of core gases as well as allow for the flushing of cooling gases and the removal of heat from the casting while it solidifies.

Helium cooling gas is a preferred gas for the casting system because of its physical characteristics compared to air or any other inert gas. Helium is inert and has a density seven times lower than air, with thermal conductivity properties six times that of air. Helium has three properties which play roles in influencing the present aluminum casting system. Specifically, Helium gas is inert, it has a low density, and it has attractive thermal conductivity characteristics. Taken individually, an inert gas mold cavity environment allows for rapid mold filling without the risk of metal oxidation and resultant casting defects. Such performance can result in faster cycle times, which improves production output per hour. The low-density gas will be pushed out of the mold cavity through the mold air venting system while the metal enters the mold with far less resistance; thus, facilitating thin-wall capability when compared to air. This results in smoother and quicker mold fill times, all while using thinner mold walls. And finally, the improved thermal conductivity will enhance the solidification process and significantly improve the efficiency of the metal mold wall because of significant heat transfer improvements drive directional metal solidification and improve aluminum metallurgy. This also results in faster cure times which translates in to increased production output per hour for a given casting station. The resulting system provides high production cycle rates due to the high metal fill rate. It also provides improved metal solidification rates resulting in improved microstructure characteristics, improved mechanical properties and thermal fatigue resistance. The present system is further flexible in that it can be used with commercial materials, such as aluminum alloys.

An improved sand mold, hard casting mold/tooling cooling concept that leverages inert gas is operable to affect the metallurgical properties of aluminum. Such concepts may be applicable to sand casting, die casting, permanent and semi-permanent mold (hard mold tooling) aluminum casting process as well. The impact of a Helium cooling gas which is inert, has low density and is highly heat conductive, will yield similar results in hard mold tooling. The cooling gas may be introduced into the mold cavity and be targeted on specific areas of the resulting casting. Hard tooling is vented to allow core gases and expanding air in the mold cavity to escape—the same venting concept can be applied in reverse to introduce helium gas into the mold cavity. The cooling gas has a positive impact on the solidification characteristics of the aluminum thus achieving a metallurgical microstructure of very low secondary dendrite arm spacing—higher strength and ductility. Productivity is also improved because of the solidification rate of the cast molten aluminum. Thus, the present disclosure may be applied to sand mold casting, die casting, permanent mold casting, and semi-permanent mold casting environments. For discussion purposes only, sand mold casting process, die casting, permanent and semi-permanent casting systems are presented. It will be appreciated that the disclosure may apply inert gas to a variety of metal casting processes.

Referring now to FIGS. 1-7, FIG. 1 in particular discloses a schematic diagram of one example of a sand molding casting system 10 for manufacturing metal castings 12 using a low-pressure casting environment deploying an anti-gravity fill system. The casting system 10 includes a transport system 14, a fixture 16 loaded with mold segments 18, a roll-over fill station 20, an inert gas source system 22, and a furnace 24. The transport system 14 includes a first portion 26 and a second portion 28 that may also be considered a cooling conveyor. Chillers 30 may be deployed near and or around the perimeter of the second portion 28 of the transport system 14 to aid in the cooling of the mold fixture 16 once it has left the roll-over fill station 20.

The transport system 14 includes motors 32, sensors 34, and PLCs 36 for controlling the operation of the casting system 14. The PLCs 36, in turn, may communicate with a main computer 38 located remotely in the foundry or elsewhere for controlling and overseeing the production environment at a given facility. It will be appreciated that the motors 32, sensors 34, and PLC 36 may be located at numerous locations within the casting system 10 and they may be operable to communicate with each other in series and/or in parallel in order to effectuate the desired performance and production output. The first portion 26 is operable to motivate a plurality of fixtures 16 from an assembly area (not shown), along a path 40, and then deliver the fixture 16 to a receiving or inlet area 42 of the roll-over station 20. The operation of each fixture 16 along the path 40 of the first portion 26 is controlled by the PLC 36. For example, the sensor 34 may sense when a fixture 16 has entered the inlet area 42, thus allowing the next available fixture 16 to advance along the casting system 10.

The roll-over station 20 is the mold pouring station for the casting system 10 and includes the inlet area 42, a base 44, a head 46 with an indexing or rotating turret 48 that is connected to the base 44, and a nozzle inlet portion 50 for communicating with a furnace nozzle 52. The rotating turret 48 is operable to index axially in the direction of arrow 54 relative to the base 44. This action allows the turret 48 to index relative to the furnace nozzle 52 during mold filling operations. For example, during mold fill operations, the turret 48 is extended outwards towards the furnace nozzle 52 so as to allow flow of the molten material such as aluminum in to the sand mold segments 18. Once the mold is full, metal flow is terminated, which then permits the rotating turret 48 to axially retract in the direction of arrow 54 so as to permit the furnace nozzle 52 to disconnect from the fixture 16.

The roll-over station 20 is operable to rotate in the direction of arrow 54 for the purpose of advancing the fixture 16 from an upright position 56 to an inverted position 58. The fixture 16 enters the inlet 42 in the upright position 56, is secured via clamping mechanism 60, and then is inverted 180 degrees to the inverted position 58 as is shown in FIG. 1. The rotating turret 48 then locks into place, which secures the fixture in the inverted position 58 during the He gas fill and the metal pour steps of the operation. The roll-over station 20 is operable to then advance the fixture in the direction of arrow 62 to the second portion 28 of the transport system 14, where it is then cooled via coolers 30. Once cooled, the fixture enters a shake-out station 62 where the formed cast part 12 is then removed from the fixture 16. The fixture is then repurposed for later re-use.

The second portion 28 of the transport system 14 includes rollers 68, similar to the rollers 68 on the first portion 26, for supporting and advancing the inverted fixture 16'. The second portion 28 includes motors 32, sensors 34, and a PLC 36, which is in turn connected 70 via a communication link to the main computer 38. It will be appreciated that the PLCs 36 could be connected using various telecommunication methods, for example blue tooth, near field proximity, or other type methods. One or more chillers 30 may be placed along the path of the second portion 28 so as to effectuate cooling characteristics of the metal in the mold segments 18.

Figure 2:
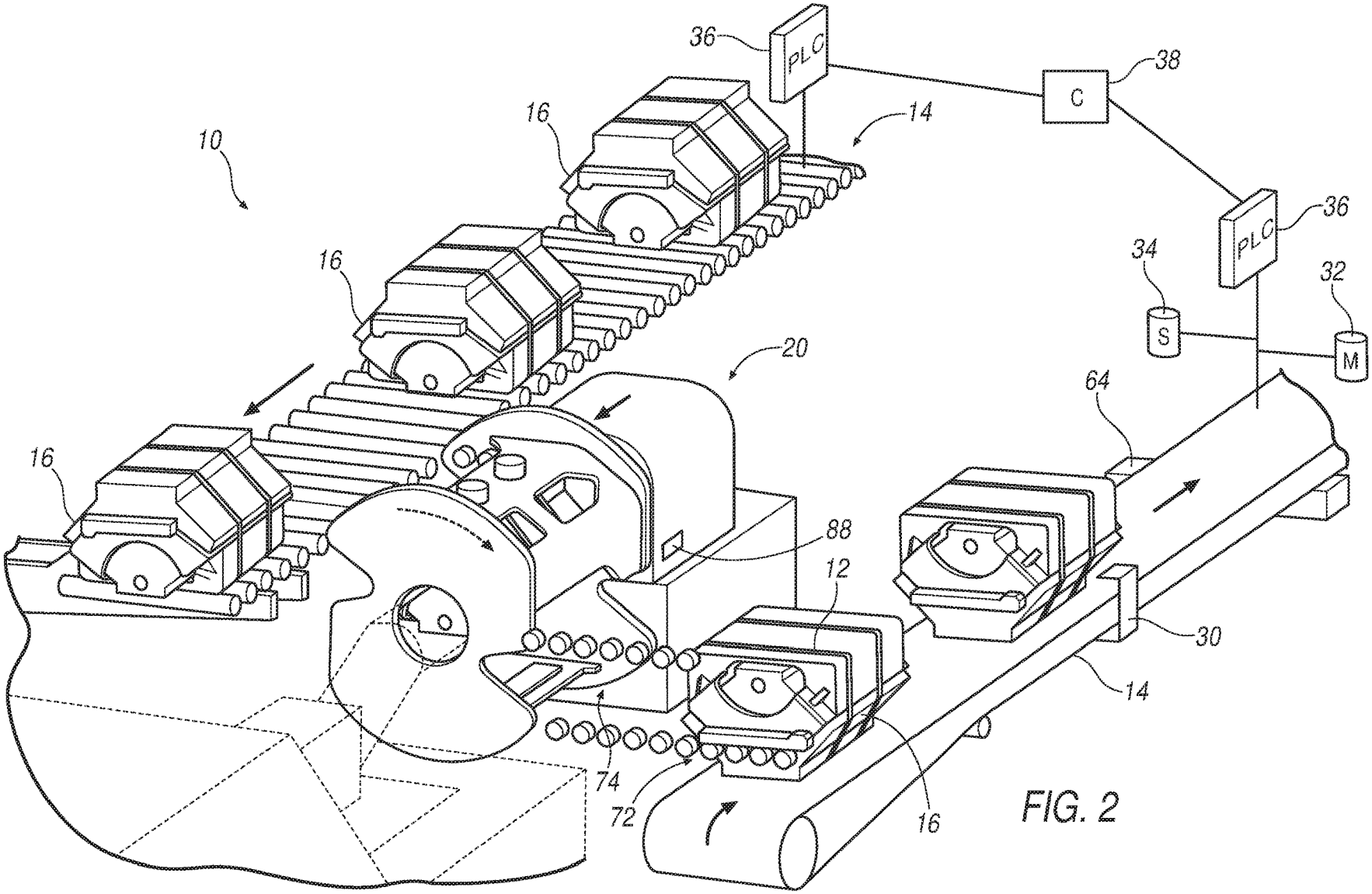
FIG. 2 is the schematic diagram of the casting system shown in FIG. 1, showing a mold leaving the roll-over system after having been filled with molten material.

FIG. 2 discloses a schematic diagram of the Casting System 10 depicted in FIG. 1, showing the mold fixture 16' exiting the roll-over station 20 after the mold fill step has been completed. A plurality of mold fixtures 16 are stationed along the transport system 14 in preparation to be introduced to the roll-over fill station 20. Here the roll-over station 20 has just completed a fill cycle and a cast part or casting 12 has been formed and is shown exiting 72, the outlet 74 of the roll-over station 20. The fixture 16' advances towards the transport system 14 and is shown inverted as that is the orientation of the fixture 16' when it exits from the roll-over station 20. This permits the anti-gravity metal fill process to be accomplished.

Figure 3A:
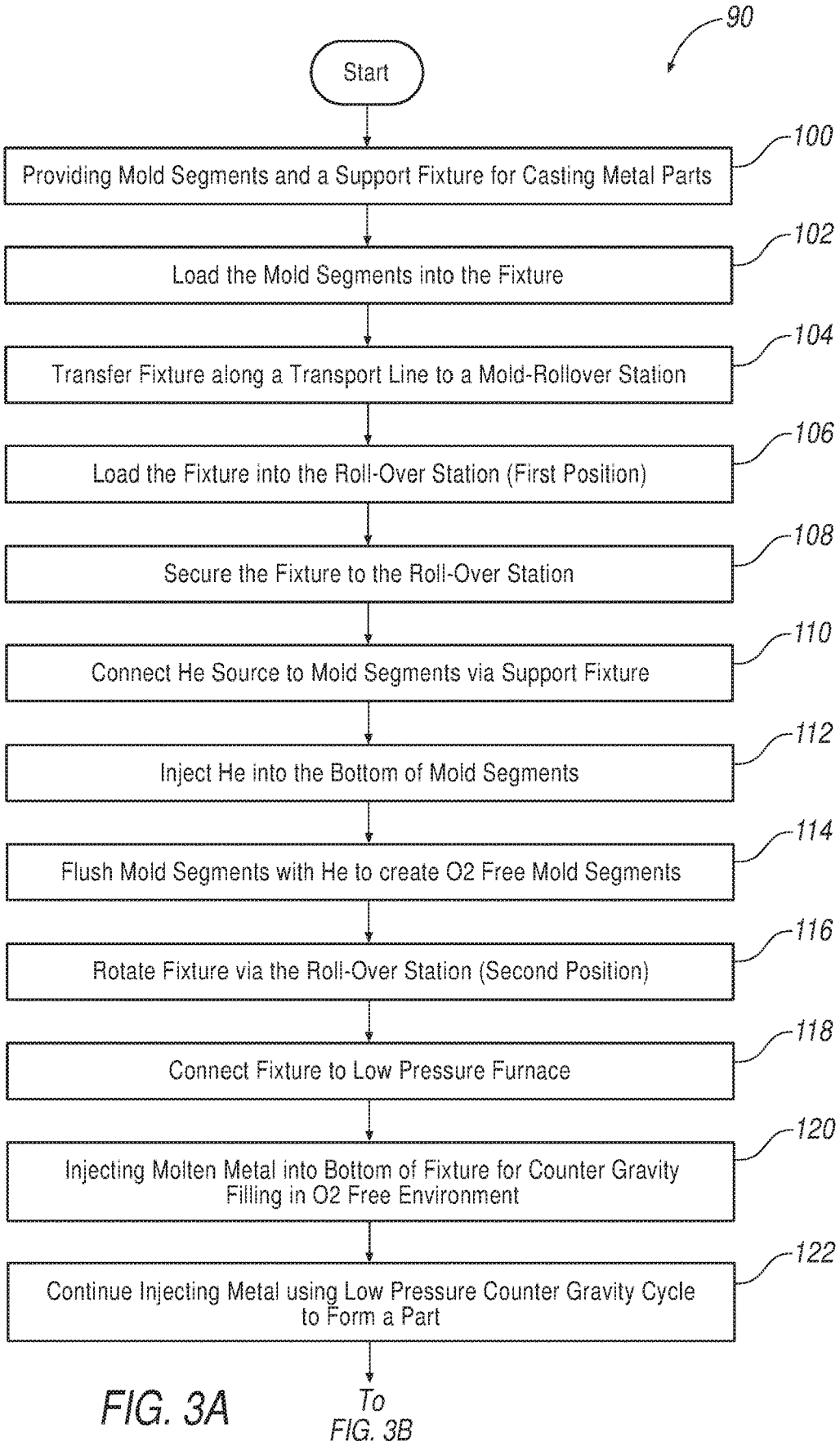
FIGS. 3A-B are a flow diagram of the method of operating the casting system shown in FIGS. 1 and 2.
Figure 3B:
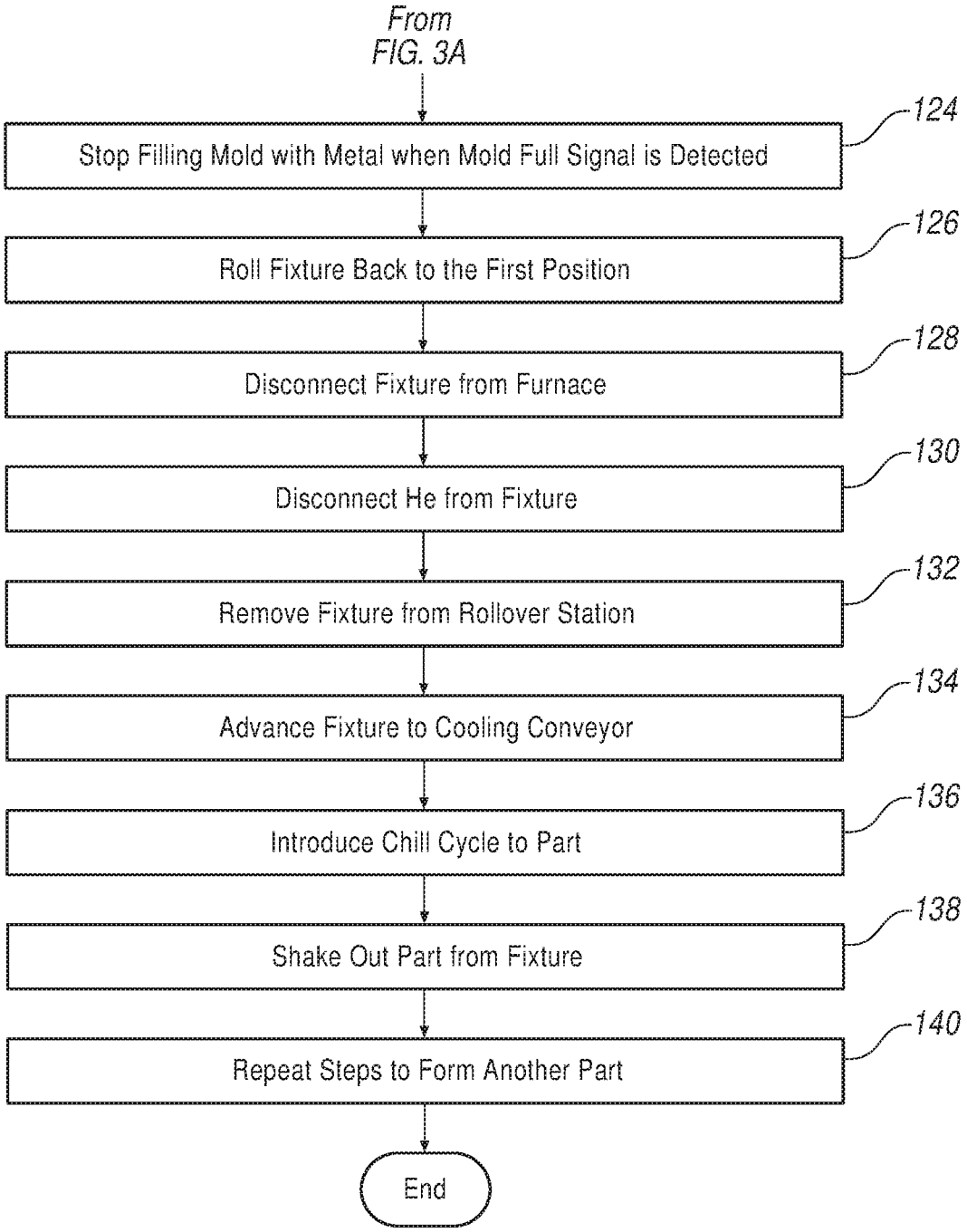

FIGS. 3A and 3B disclose an exemplary casting flow diagram or process 90 illustrating one example of a method of manufacturing a casting 12 using the casting system 10 that is depicted in FIG. 1. It will be appreciated that while the method presented discusses employing He as the inert gas, other inert gasses such as $N_2$, or others, are contemplated by this disclosure. Further, the method 90 of operating the casting system 10 may include fewer or more of the following steps. This is but one example of how the method of operation could be contemplated.

1. Providing mold segments and a support fixture for casting metal parts.
2. Loading the mold segments into the fixture.
3. Transferring fixture along a transport line to a mold roll-over station.
4. Loading fixture into the roll-over station (first position).
5. Securing fixture to the roll-over station.
6. Connecting He source to mold segments.
7. Injecting He into bottom of mold segments.
8. Flushing mold segments with He to create $O_2$-free mold segments.
9. Rotating fixture via the roll-over station (second position).
10. Connecting fixture to a low pressure furnace.
11. Injecting molten metal into bottom of fixture for counter-gravity filling in an $O_2$-free environment.

12. Continuing to inject metal using low-pressure, counter-gravity cycle to form a part.
13. Stopping fill of mold with metal when mold full signal is detected.
14. Rolling fixture back to the first position.
15. Disconnecting fixture from furnace.
16. Disconnecting He source from fixture.
17. Removing fixture from roll-over station.
18. Advancing fixture to cooling conveyor.
19. Introducing chill cycle to part.
20. Shaking out part from fixture.
21. Repeating steps to form another part.

The method of casting 90 may begin with step 100, which is providing mold segments and a support fixture for casting metal parts, may include the mold segments 18 being individual molds that are aligned in segments such that they can be encapsulated and held in place by the fixture 16 during the molding process. After the casting process is complete, the mold segments are destroyed during the shake-out process so as to separate the cast part 12 from the fixture 16'. The fixture in turn can be reused for another mold cycle by installing new mold segments 18. It will be appreciated that based on the design of the casting part 12 to be manufactured, that a single segment 18 or segments aligned in different fashions may be employed.

The next step 102 is loading mold segments 18 into the fixture 16, and this step may include inserting a plurality of individual segments 18 which collectively form the mold 76. This step can be performed off-line and in a staging area.

The next step 104 is to transfer the fixture 16 along a transport line 14 to a mold roll-over station 20, where molten material is introduced to the mold 76. The fixture transfer process may be controlled by the main computer 38, which in turn my have human interface for selectively controlling the operations.

The next step 106 is to load the fixture 16 into the roll-over station 20 which is shown in FIG. 1 as a first or upright position. The fixture enters the roll-over station 20 by rolling off the transport system 14 and into the inlet 50 of the roll-over station 20. Once the fixture is advanced to this position, another fixture 16 on the transport system 14 is advanced so that it can be staged and ready to be processed at the next available pour cycle.

The next step 108 is to secure the fixture 16 to the roll-over station 20. This may be accomplished by using an automated locking system having clamps and sensors that communicate with the computer 38. This securing step 108 holds the fixture in place when it is rotated 180 degrees before the fill cycle.

The next step 110 is to connect the He source 22 to the mold segments 18 or mold 76. This step provides the supply of inert gas, such as He, to the mold 76 so that a constant supply of He can be delivered at predetermined pressures and predetermined flow rates. This results in a controlled He infusion process which can be adjusted based on the mold's geometry. The He source 22 can be controlled by the PLC 36 or computer 38, and thus the He delivery process can be specifically controlled so as to yield a certain result within the mold 76. For example, for a mold 76 with many mold segments 18, the rate of gas delivery to the mold's cavity can be controlled so as to have the rate of infusion of the inert gas calculated to exhaust Oxygen from the cavity of the mold in the best possible way.

The next step 112 is to inject He into the bottom of the mold segments. This step starts the process of removing $O_2$ particles from the base of the mold cavity.

The next step 114 is to flush the mold segments 18 with He under a predetermined pressure and flow rate so as to create an environment of $O_2$-free mold segments, along with any other particles that may be present in the cavity of the mold segments. This is the step where the inert gas source system 22 continuously works to flush the entire cavity with inert gas sufficient to evacuate all $O_2$, and penetrate the porous walls of the mold to form a barrier layer of inert gas on the surface of the inner wall cavity. This barrier layer of inert gas helps the thermal cooling performance as it has high thermal conductivity. A goal of this step may be to provide total He gas saturation within the mold cavity 76. Another goal is to provide targeted He gas delivery to specific sections within the mold cavity, and that can be accomplished by the inert gas source system 22 working in concert with, for example, a manifold delivery system. (See FIG. 6.)

The next step 116 is to rotate the fixture 16 using the mold roll-over station 20 to a second or inverted position 58. By rotating the fixture 180 degrees, this facilitates an anti-gravity molten metal fill process. Constant inert gas pressure may be applied during this roll-over process so that positive pressure is maintained within the cavity to aid in keeping $O_2$ for reentering the mold cavity. This process will help keep the mold cavity saturated with inert gas before and during the mold fill process.

The next step 118 is to connect the fixture 16 to the low-pressure furnace 24. This can be accomplished by the turret 48 indexing axially in a direction opposite of arrow 54. The turret 48 indexes to the point where it fully connects to the nozzle 52 which extends outward from the body of the furnace 24. Once the nozzle 52 is connected to the turret 48, this becomes the metal pour fill position and such is maintained during the pour fill cycle.

The next step 120 includes injecting into bottom 78 of fixture 16 molten metal 80 using a counter gravity filling process where molten metal 80 is delivered in an $O_2$-free environment. The counter-gravity filling process results in introducing molten metal 80 in the bottom 78 of the sand mold using a low-pressure system furnace delivery system. The pressure range employed in this counter-gravity filling process could be in the range of 5 psi to 20 psi and the flow rate could be in the range of 5 to 25 pounds/second. By introducing the molten metal 80 using this counter-gravity methodology, the molten metal 80 will displace the He within the cavity as the pressurized molten metal traverses from the bottom of the cavity 78 and makes its way upward, against gravity, through the internal spaces 82 of the cavity. As the metal 80 continues to displace the He and travel upward against gravity, the He is exhausted out a degassing valve 222 near the top of the fixture 16. (See FIG. 4) This process continues until a predetermined amount of metal 80 has been introduced in to cavity such that the cavity has been filled.

Figure 4:
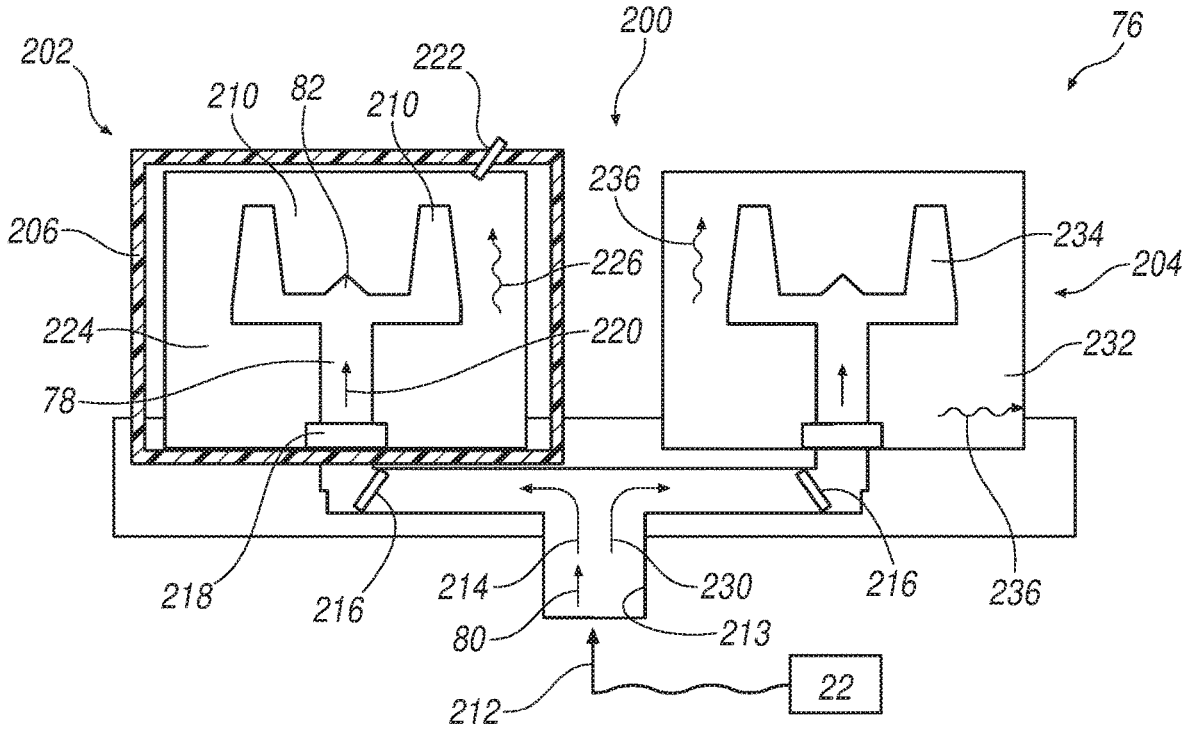
FIG. 4 is an illustration of an alternative sand casting mold for making metal parts using a mold having a sealed compartment that can be injected with Helium.

The next step 122 is to continue injecting metal using low-pressure counter-gravity cycle to form a casting part 12. This is improved by the deployment of He in the cavity which improves fluid flow. The He further reduces turbulent metal flow within the cavity which permits a more rapid fill rate because, in part, there is less push back because the air has been removed from the cavity. This step includes the low-pressure furnace 24 delivering molten metal 80, aluminum for example, but other metals are contemplated by this disclosure, through the furnace nozzle 52 which in turn directs the metal 80 to the mold cavity 76. FIG. 4 illustrates an example of a cross-section of one such mold cavity 76, which is discussed further below. Metal 80 enters the bottom of the cavity and is forced up and through the cavity. This fill process continues for a predetermined period of time which may be controlled by the computer 38, or a separate fill system having its own sensors, valves, and control logic.

The next step 124 is to stop filling the mold with molten metal 80 when a mold full signal is generated by a mold fill sensor 84. The sensor 84 may be situated near the top 86 of the mold. The sensor may communicate with the PLC 36, the computer 38, and/or a separate fill system. The fill sensor 84 may be on board the fixture 16, as is shown in FIG. 1, or inside the mold cavity 76, or the sensor 84 may be positioned elsewhere relative to the casting system 10. Stopping the flow of metal to the mold may be accomplished by other means, which are contemplated by this disclosure.

The next step 126 of the casting process may include rolling the fixture 16 back to the first position 26. This would be the same orientation as the fixture 16 had when it entered the roll-over station 20 at the beginning of the fill cycle. See FIG. 1. By contrast, it will also be appreciated that this step may be avoided and the fixture with the newly molded casting part 12 may be kept inverted, as is shown in FIG. 2, and then exited from the roll-over station 20. The decision how to orient the fixture at this stage of the process 90 provides for a flexible method of operation.

The next step 128 is to disconnect fixture 16 from furnace 24. This can be accomplished by retracting the turret 48 in the direction of arrow 54 so as to cause the nozzle 52 to disengage the inlet 50 of the turret 48. It will be appreciated that this step may be accomplished using a drive system 88 that may be on-board or external to the roll-over station 20. The drive system 88 is operable to control the indexing of the turret 48 relative to the base 44 at predetermined periods of the metal pour cycle.

The next step 130 is to disconnect the He from fixture 16 so as to no longer deliver pressurized He to the fixture 16. This may be accomplished manually or by the system 10 being automated in this regard so long as the inert gas source system 22 is no longer delivering a supply of gas to the cavity. The inert gas system 22 may include a supply tank, lines, valves, sensors, gauges, and its own controller.

The next step 132 is to remove the fixture 16 from roll-over station 20. This may be accomplished in several ways, one of which could include actuators propelling the fixture 16 in a direction 62 away from the roll-over station 20 so as to advance the fixture 16 towards the second line 28 which could also be referenced as a cooling conveyor.

The next step 134 is to advance the fixture 16' to the cooling conveyor which embodies the second line 28 for the final processing of the fixture. Once the fixture 16' is securely positioned on the cooling conveyor 28, the roll-over station 20 is now free to accept another fixture 16 that in turn can be loaded, and thus a new mold fill process can begin once it is has been properly positioned.

The next step 136 is to introduce chill cycle to the fixture 16' and thus the part 12 that is now curing within the fixture 16'. By employing chillers at this stage, the part 12 will begin cool quicker which results in improved part characteristics. The chill cycle may be accomplished by the use of chillers 30 that are shown in FIGS. 1 and 2 in schematic form where the chillers 30 may be placed in close proximity to the cooling conveyor 28. One or more chillers 30 may be deployed in this casting system 10. The chillers 30 may encapsulate the fixture 16' as the fixture 16' traverses along the conveyor, or they may be lesser configured as is shown in the FIGS. The chillers may be flexible and programmable so as to exert a predetermined amount of cooling capacity so as to meet the cooling preferences on any given fixture 16' as it traverses the conveyor. For example, if a fixture 16' is hosting a casting part 12 that has a large dimensional characteristic, then the chillers 30 may be programmed to deliver a high cooling capacity so as to cool the part 12 at a preferred rate of cooling. By contrast, if the fixture 16' is hosting a smaller part 12 to be cast, then the chillers 30 may be programmed to deliver a lower cooling capacity.

The next step 138 is to shake out the part 12 from the fixture 16. This is done after the chillers 30, if any, have completed their cooling cycle and thus the part 12 is ready to be broken away from the fixture and the sand molds therein. The shake out step 138 may be accomplished using conventional means in the industry. However, one variant here is that the fixture 16' will be preserved and repurposed so as to be deployed again in another casting process 90. Thus, the shake out process 138 contemplates a recovery system for the just used fixture 16', a procedure for separating out the dirty sand, and for then advancing the new part 12 to a finishing station.

The next step 140 is to repeat steps 100-138 to form another casting part 12. This casting process 90 contemplates employing the casting system 10 over and over again so that a continuous mold line can operate at varying capacities. For example, prototype mold casting runs can be envisioned with the present system because it is flexible in that fixtures 16 can be loaded on to the transport system 14, all the while the parts 12 to be formed can be of different sizes and shapes. The computers 38 and PLCs 36 may permit selective programming for each fixture 16, which in turn allows for the mold fill cycle to be uniquely controlled, and the chill cycle to be uniquely controlled, all based on the desired characteristics for a particular part 12. The mold fill cycle can contemplate steps 102-132, while the chill cycle can contemplate steps 134-136.

Another example of the flexibility of the present system is that small prototype runs may be intermixed with large scale production runs. This can be accomplished because each fixture 16 may have its own mold parameters 140, 142, and so on. Each mold parameter may be a unique set of instructions, data sets, characteristics, and the like, that are particular to the part 12 that is to be cast. For example, one mold parameter 140 could be specific instructions regarding the part to be manufactured, part size, target weight, inert gas type to be delivered to the cavity, rate of gas delivery, pressure rate of gas delivery, cycle time, mold fill cycle time target rates, metal type, chill cycle times, target part material properties, etc. Any bit of information that may be important, specific, and/or unique to the part 12 to be cast could be contemplated as a mold parameter 140, 142. The mold parameters 140, 142, may be saved in a storage system that is connected with the computer 38 and/or housed in the cloud.

It will also be appreciated that on large scale casting production runs, the casting system 10 can be deployed where the identical part 12 can be cast for extended periods of time, such as days, weeks, months, even years. If a part changeover is later desired, then the mold parameters 142 for the next desired part can be set up and programmed, and because the system 10 is flexible, the production line can be easily transitioned to casting another part as desired.

FIG. 4 discloses an illustration of but one sand casting mold 76 for making metal parts using the casting system 10 and casting method 90 set forth herein. The casting mold 76 may have a sealed mold compartment that can be injected with inert gas such as Helium as well as un-unsealed mold compartment. It will be appreciated that the molds 76 used with the casting system 10 may have only one cavity, or more than one cavity, which is style illustrated. It will also be appreciated that the cavity 76 may have a plurality of cavities, all of which could be sealed or unsealed. For demonstrative purposes only, FIG. 4 shows both a sealed and an unsealed (full of air) cavity.

The sand casting mold 76 includes cross-sections 200 with an exemplary mold cavity section 202 having a sealed configuration and a non-sealed 204 cavity configuration. The sealed cavity section 202 includes a seal 206 that creates a sealed environment for surrounding and segregating the permeable sand mold 208 from the rest of its environment. The seal 206 may be a bag, liner, or other device that is operable to withstand the internal operating characteristics that are present in the casting environment. The seal 206 encapsulates the sand mold 208 and is operable to keep air out while maintaining inert gas inside the liner during the mold pour cycle. The seal is capable of withstanding pressures in the range of 5 psi to 50 psi. Within the center of the sand mold is the cavity 210 which takes on the form of the cast part 12 that is to be formed in this foundry process.

Inert gas 212 such as, but not limited to He, is introduced at an inlet 213 into a mold gate and it traverses along a path 214 to where an inlet valve 216 may control the flow of gas 212. Gas 212 passes past the valve 216 through a seal member 218 that is positioned adjacent a lower portion of the liner 206. Gas 212 then is forced in the direction of arrow 220 to where it permeates and saturates the cavity 210. A degassing valve 222 is positioned at an opposite side of the sealed liner 206. Within the sealed liner 206 is an internal environment 224 wherein gas particles 226 are forced up and out of the environment through the degassing valve 222. Before the internal environment 224 is flushed with an inert gas, it contains atmospheric contaminates such as $O_2$, and others, which can be flushed out with the aid of the pressurized inert gas system 22. The gas 212 flow and pressure rates may be controlled by the system 22 so as to achieve a desired part performance.

With continued reference to FIG. 4, an air cavity section 204 is depicted that does not have a sealed liner 206. This is considered an air mold that is operable to deploy other aspects of the inert gas infusion system disclosed herein. In particular, gas, such as He, traverses along a path 230 and through a valve 216 and onward up into the permeable sand mold 232 and the cavity 234. The gas 212 continues to fill the sand mold 232 as long as the valve 216 remains open. As the gas 212 enters the sand mold 232 is forces particles 236 up and out of the sand mold 232 in many directions. Because no seal liner 206 is present in this embodiment, the atmospheric pressure will permit $O_2$ particles to reenter the sand mold 232 if a positive pressure is not maintained via the inert gas supply system 22. Thus, maintaining positive He pressure will aid in keeping impurities out of the sand mold 232 during the molding cycle.

Figure 5A:
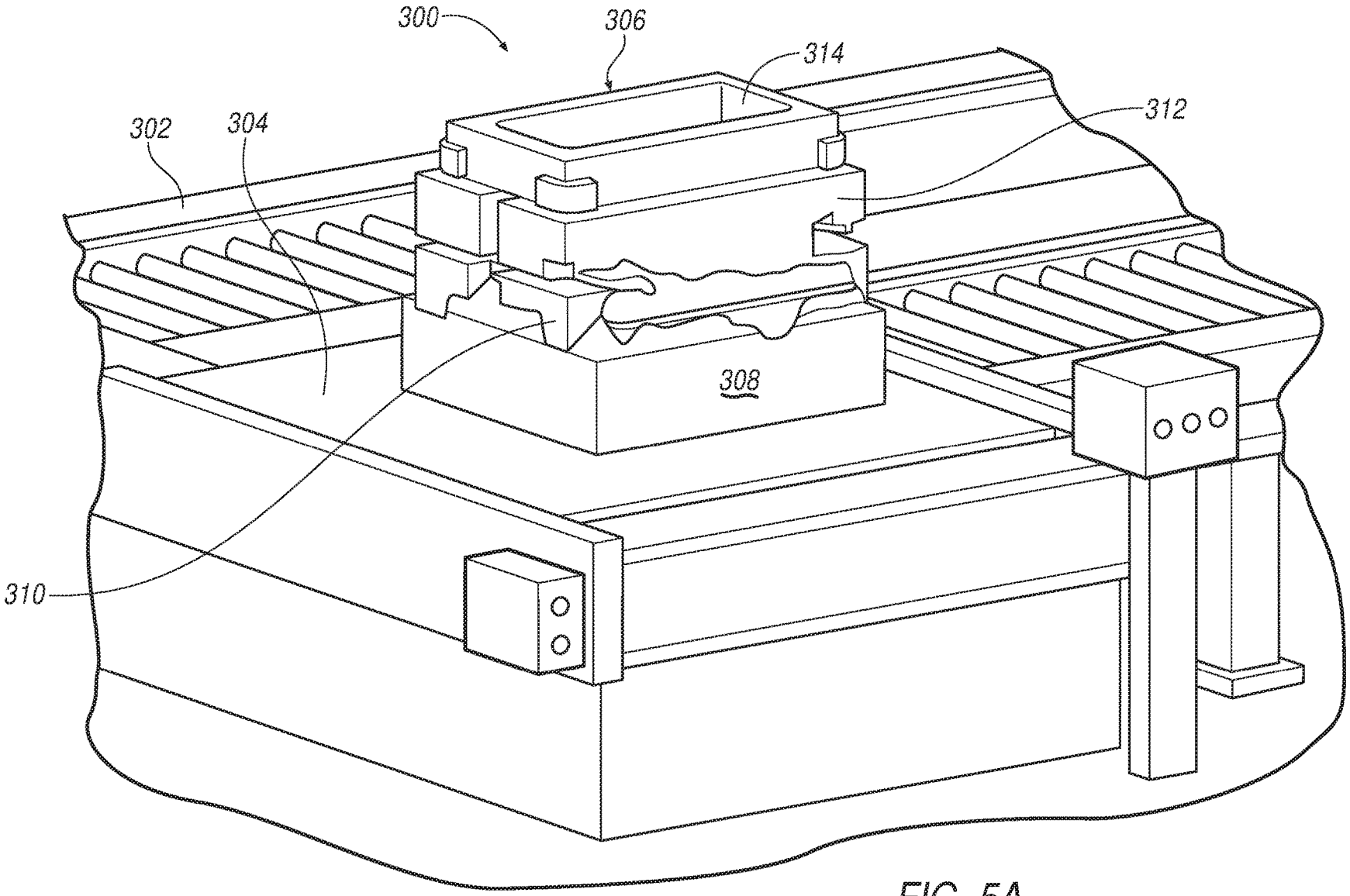
FIGS. 5A-5C are schematic representations of an alternative low-pressure casting system having a chamber environment deploying a mold placed in a chamber that is injected with Helium to form a part in an O2-free environment.
Figure 5B:
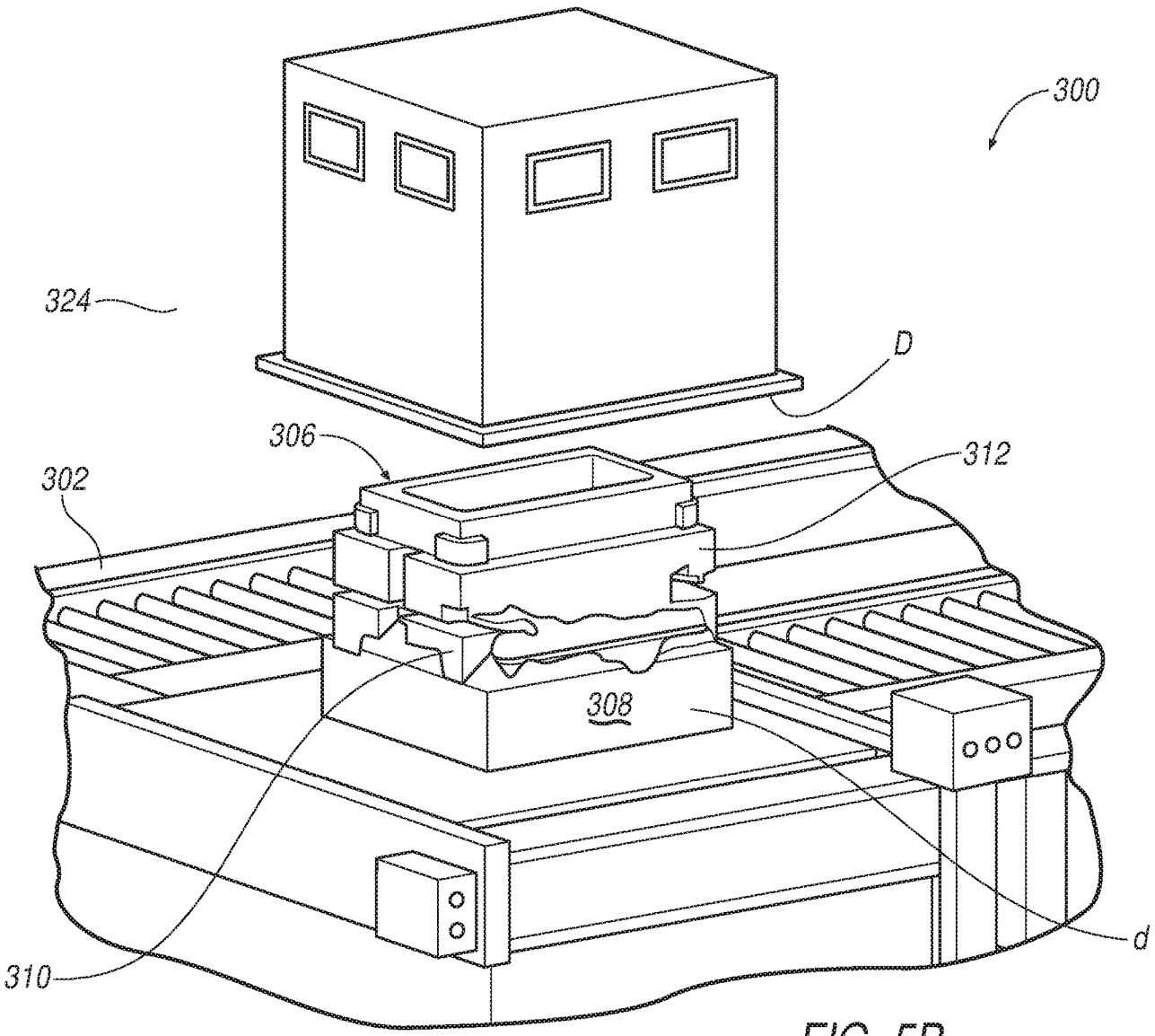
Figure 5C:
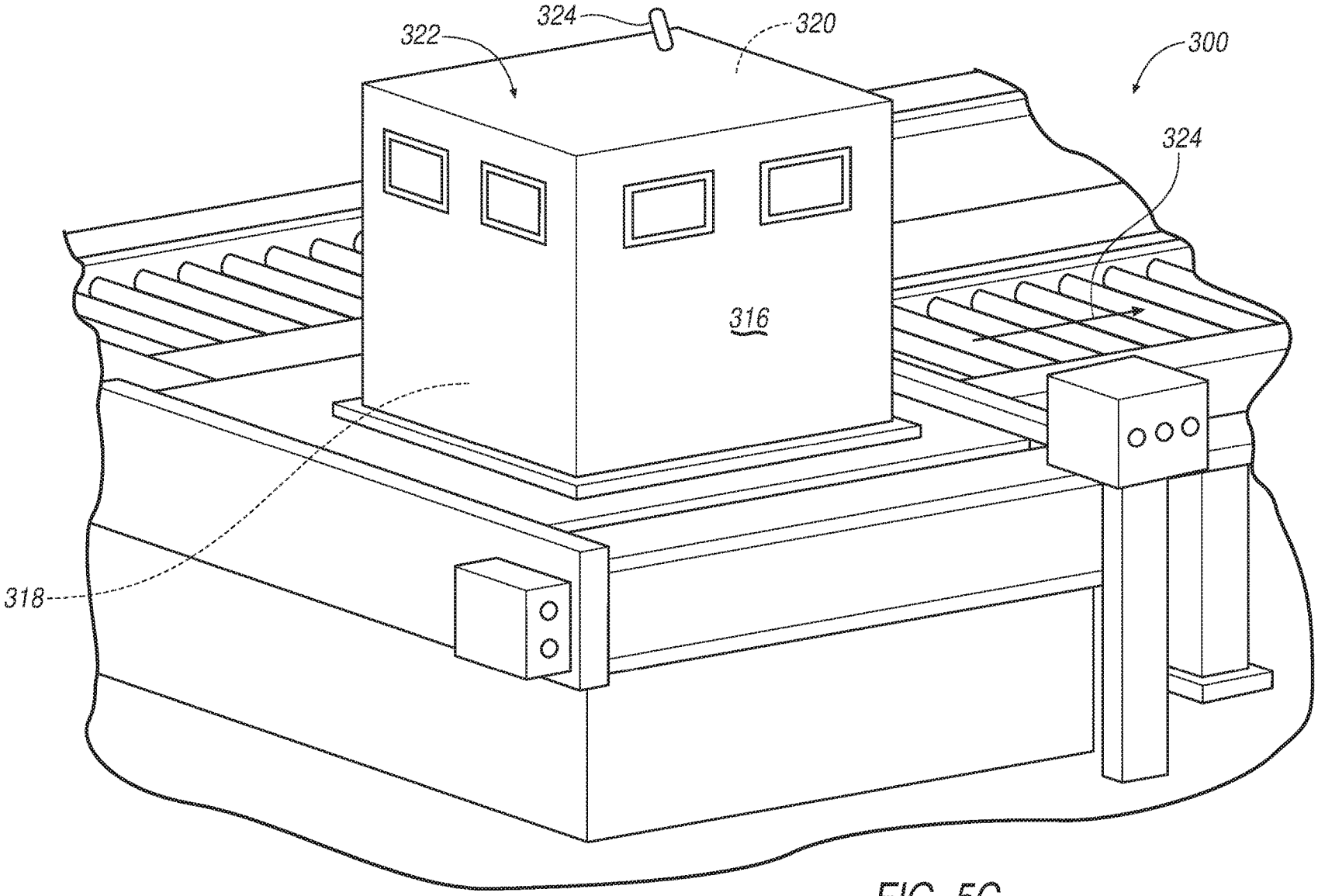

FIGS. 5A-5C disclose schematic representations of an alternative low-pressure casting system 300 using a mold placed into a chamber that is injected with Helium to form a part in an $O_2$ free environment. Referring to FIG. 5A, this alternative casting system 300 includes a mold transfer line 302 and a staging area 304 for preparing a mold 306 for casting a part. The mold 306 may be a permanent or semi-permanent type sand casting mold. The mold 306 may have a base or fixture 308, a drag 310, a cope 312, and a pour cavity 314.

With reference to FIG. 5B, a cover 316 is provided and presented over the top of the mold 306. It has an internal dimension D that is slightly larger than the outer dimension d of the fixture 306 so as to permit the cover 316 to be lowered and mated to the mold 306 whereby minimal gap is presented between these two structures. FIG. 5C illustrates the cover 316 having been completely positioned in place over the top of the mold 306 so as to form a sealed chamber 318. The sealed chamber 318 creates an enclosed environment 320 for the mold 306 to reside, and for an inert gas to be inserted. Once the cover 316 is in place, the mold fixture 322 (the mold 306 and the cover 316 combined), is advanced in the direction of arrow 324 to a mold fill station where an inert gas is introduced to the sealed chamber via an inert gas source system 22. Once the $O_2$ particles have been flushed via a degassing valve 324 from the sealed chamber 318 with an inert gas, a low-pressure furnace 24, or other furnace system, begins to fill the mold 306 with molten material. It will be appreciated that aluminum castings, or other materials, may be used in this process.

Figure 6:
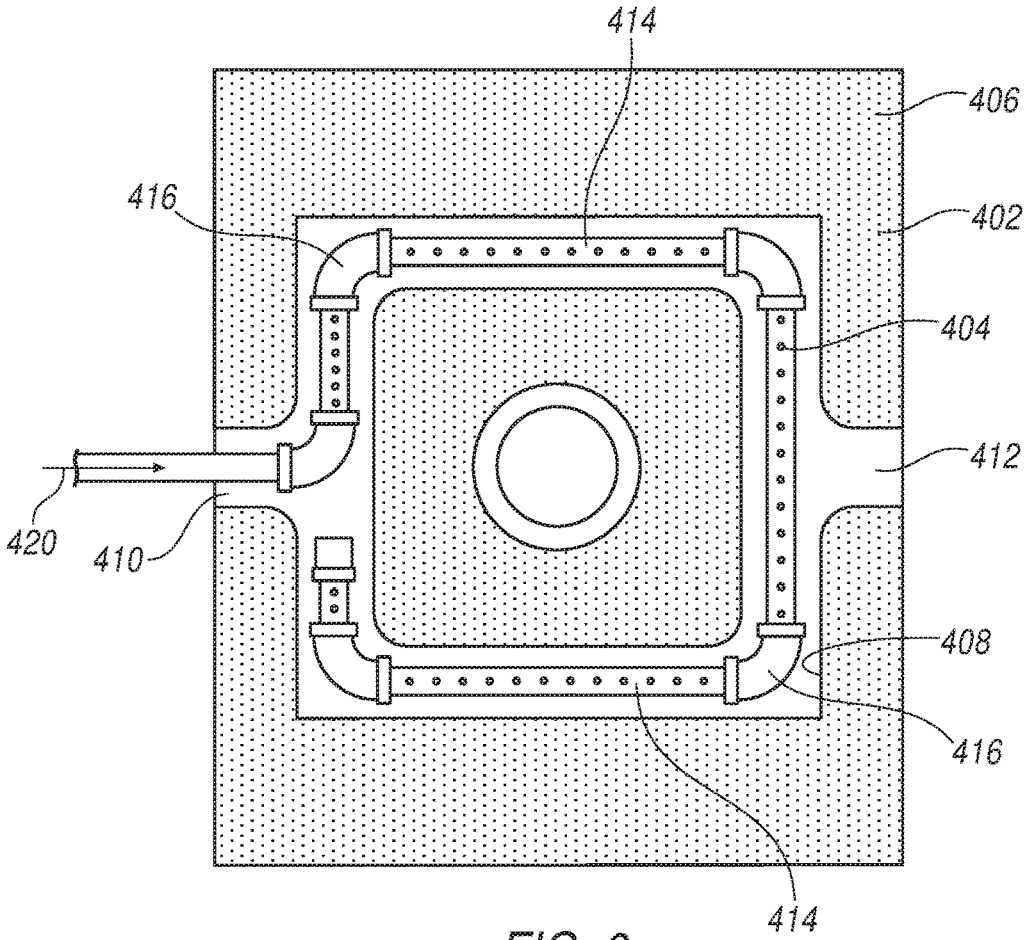
FIG. 6 is a schematic diagram of an alternative metal casting system that uses a manifold system for delivering gas, such as Helium, into a lower portion of a mold during the casting process.

FIG. 6 discloses a schematic diagram of an alternative metal casting system that uses a manifold system 400 for delivering gas such as Helium in to a mold during the casting process. The manifold system 400 may be deployed in the casting system 300 that is shown in FIGS. 5A-5C. The manifold system 400 includes a sand mold drag 402 and a piping system 404. The drag 402 has a body 406, a recessed channel 408, an entrance 410 and an exit 412. The recessed channel is deep enough to receive the piping system 404. The recessed channel 408 provides a void for also delivering inert gas to the cavity of the mold.

The piping system 404 includes a plurality of pipes 414 and elbows 416, preferably made of metal, that are connected and progress through the recessed channel 408. The pipes 414 include gas openings 418 that permit inert gas to be released out of the piping system 404 and directed towards the mold cavity. Inert gas flows in to the drag 402 in the direction of arrow 420 and is routed through the piping system.

Figure 7:
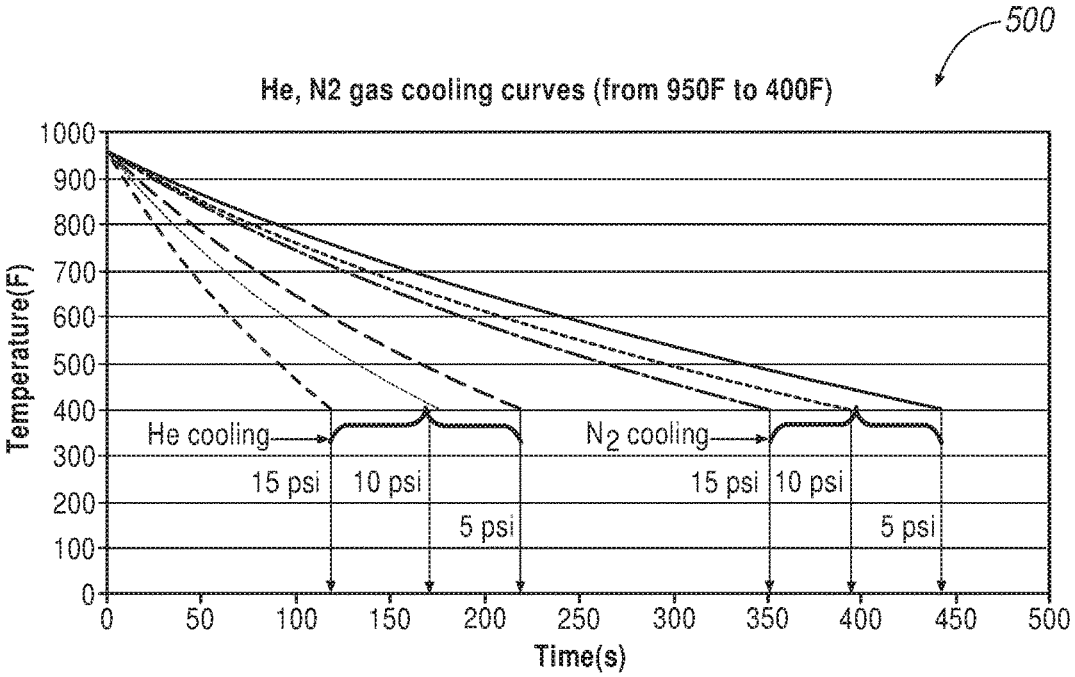
FIG. 7 are Helium [He] and Nitrogen [N2] gas cooling curves showing casting cooling times relative to temperature.

FIG. 7 discloses He and $N_2$ gas cooling curves 500 showing casting cooling times relative to pressure. In these figures graphs are depicted via curves showing furnace low-pressure injection rates of 5 psi, 10 psi, and 15 psi. The casting system 10 operates well within these pressure ranges. The Helium cooling affect also measurably reduces aluminum dendrite cell spacing [DCS], an equivalent technical term for commonly used secondary dendrite arm spacing [SDAS]. The cooling curves 500 illustrate performance graphs that show He cools much faster than $N_2$, the result of which is that faster production cycle times can be accomplished.

The efficiency of Helium as a cooling gas and the impact on the aluminum metallurgy has been evaluated under two very distinct test environments: [1] measure the cooling rate of Helium and Nitrogen on a preheated slug of aluminum, and [2] measure the cooling rate of Helium and Nitrogen in an encapsulated sand mold environment when filled with molten aluminum.

The first test was to measure the cooling effects of Helium and Nitrogen gas in a close-to-open system where a preheated aluminum specimen was surrounded by the ceramic fibers. The highly permeable ceramic fibers generated virtually no back pressure in the system. The cooling curves of the preheated 6061 aluminum cylinder from 950 F to 400 F under different cooling gases and different gage pressures showed: [1] the mass flow rate of Helium is always higher than that of Nitrogen under any pressure applied, and [2] the cooling rate of the preheated metal increases with cooling medium mass flow rate. The results are consistent with the statistical thermodynamics gas theory. The gas theory predicts that Helium molecules have a slightly lower heat capacity than Nitrogen [by ~30%], but travel much faster [by ~160%] than Nitrogen under any given temperature because of its lower molecular weight than Nitrogen (4 to 28). For a given gage pressure [≈overall pressure differential] there are significantly more Helium molecules available to remove heat than Nitrogen. Consequently, this gas cooling efficiency test demonstrates very clearly the measurably higher cooling rates for Helium gas when compared to air.

In the second test, Helium and Nitrogen gas was applied to a sealed sand mold before and during casting solidification. In addition, a mold was poured without any gas flow simulating a conventional sand mold filling environment. The cooling curves decidedly show the cooling effect of Helium gas compared to Nitrogen gas as well as a comparative cooling curve for a conventionally solidified mold environment. The thermal data strongly suggests that Helium cooling will cause a DCS reduction based on the well-known relationship between aluminum alloy DCS and local solidification time. This test data supports application of inert gas to the casting process for not only sand castings, but also die casting, permanent and semi-permanent casting operations.

Figure 8:
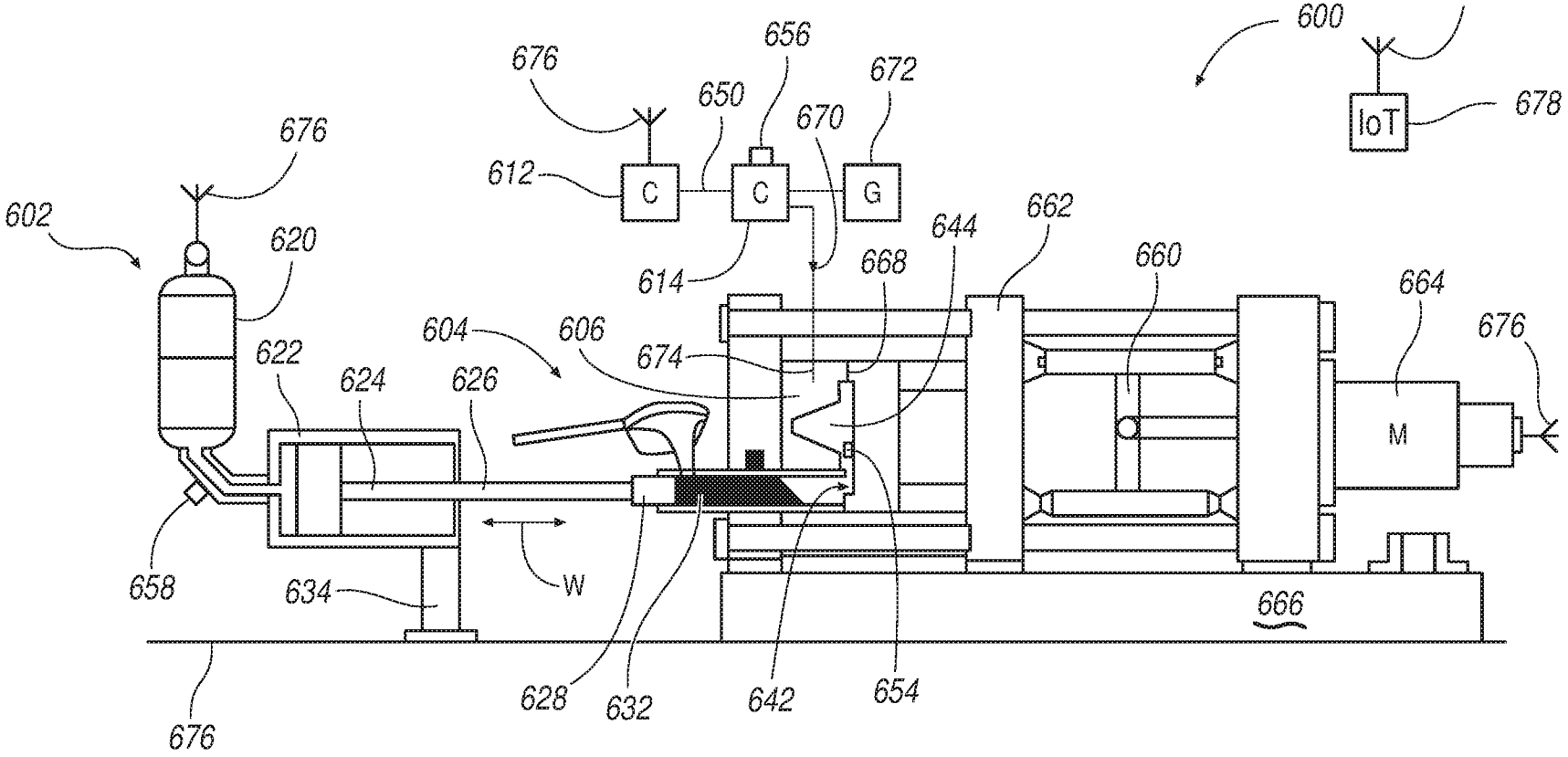
FIG. 8 is a schematic diagram of an alternative casting system, showing the foundry steps of die casting, including the step of a mold cavity being filled using inert gas.

FIG. 8 represents a schematic diagram for an alternative foundry casting system using a die casting system 600 and method for making a part such as, but not limited to, an aluminum part for use in industries such as, for example, aerospace and automotive. It will be appreciated that this system 600 may be used to founder parts made of other metal types, with various sizes and geometries, and such system could also be deployed in low volume prototype and/or high volume production run type environments. The die casting system 600 may include a high pressure delivery system 602, a metal pour system 604, a die 606, sensor monitoring system 608, a machine 610, a central processing unit 612, and an inert gas delivery and control system 614.

The high pressure gas delivery system 602 includes an accumulator 620 that provides nitrogen to a cylinder 622, which in turns drives a plunger 624. The plunger 624 includes a piston 626 and at one opposing end it includes a rain 628 that is in turn received within a shot sleeve or channel 630 of the metal pour System 604. The high pressure delivery system 602 provides constant controlled pressure on the molten metal 632 as the piston 626 traverses in the direction of arrow W. The high pressure system 602 may be secured to a support 634 which in turn can be mounted to a floor 636 of a factory.

The metal pour system 604 may include a furnace (not shown) and a hot metal delivery system or device such as a ladle 640 for delivering molten metal 632, such as aluminum or other metal, when in a liquid state to the shot sleeve 630. When the metal 632 is in the shot sleeve 630 it accumulates, becomes pressurized and starts to flow in the direction of arrow 642 which provides a flow of metal to the inlet of the die 606. The metal 632 at this stage remains superheated and begins to flow towards a cavity 644 within the die 606. It will be appreciated that various sensors as part of the sensor monitoring system 608 may be positioned relative to the metal pour system 604 for providing various feedback as to the status and performance of the system 600.

The sensor monitoring system 608 is connected 650 to the CPU 612 and provides automatic operational feedback regarding the various sensed conditions of the operation of the system 600. For example, sensor monitoring system 608 may include a plurality of separately located sensors that are disposed about the system 600. Further, the sensor monitoring system 608 may include sensor 652 that may provide data regarding the condition of the metal pouring system 604. A sensor 654 may provide data regarding conditions relative to the die 606. A sensor 656 may provide data regarding the conditions that are relative to the inert gas delivery and control system 614. A sensor 658 may provide data regarding the conditions that are relative to the high pressure system 602. Collectively, or individually, these sensors may communicate, via hard wire and/or via telemetry, with the CPU 612. The CPU 612 in turn processes said data to efficiently control operation of the casting system 600. An inert gas control system is provided that contemplates delivery, maintenance, and discontinuance of an inert gas based on operating conditions that are communicated by said sensors.

The machine 610 includes a clamp 660, a platen 662, a drive motor 664, which collectively sit upon a base 666. The die 606 is clamped and is held in place via the platen 662 during casting operation and is operable to move between an open position, and a closed position (which is shown in FIG. 8). The die 606 is vented 668 which provides for exhaust gases, including inert gases, to escape during the casting process.

The CPU 612 may be connected to a network or its own stand-alone computer system. The CPU 612 communicatees with the various systems of the die casting system 600 and controls them collectively to provide an efficient casting process. The CPU 612 may include controllers that facilitate operation of solenoids at various locations of the system to enhance effective operation of the system 600.

The inert gas delivery and control system 614 communicates with the CPU 612 and the sensors 654 that are within or in proximity to the die 606. The inert gas system 614 includes a supply source 672 which may provide a supply of Helium, Argon, Nitrogen, or other inert gas. The gas system 614, may, either alone or in concert with the CPU 612, control and monitor the flow of inert gas 670 from the supply source 672 as the gas travels to the die 606. The inert gas system 614 may include a series of inert gas passageways 674 located within the die 606 for delivering gas 670 to various areas of the die 606 at predetermined time periods within a casting cycle. A communication device 676 may be placed with the high pressure system 602, motor 664, and elsewhere, and with the CPU 612 so as to provide communication within the system 600. The communication device 676 may be wireless, blue tooth, near field, and/or other contactless methodology of transmitting data and/or signals about a system. Further, the system 600 may be connected to the Internet of Things (IoT) to a remote system and/or network 678.

Figure 9:
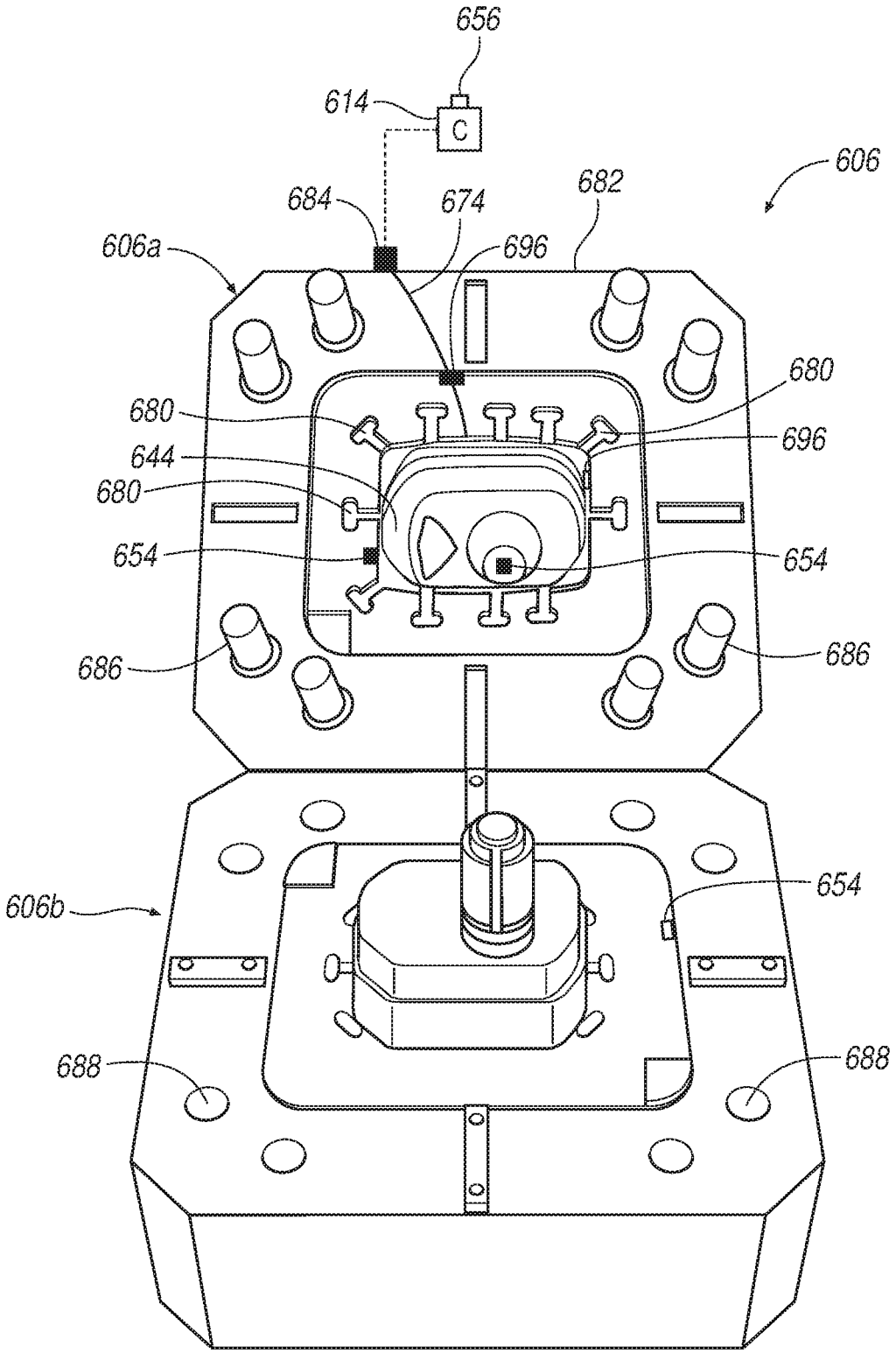
FIG. 9 is the die used in the casting system of FIG. 8, showing the two sections of the die opened along with an inert gas supply and venting arrangement.

FIG. 9 illustrates an exemplary die 606 that may be used in the casting system 600 that is shown in FIG. 8. The die 606 includes a first member 606A and a second member 606B, the first member 606A is shown schematically opened up so that the internal aspects of the die 600 can be depicted. The die 606 depicted is a single mold single cavity type for casting a single part each cycle. However, it will be appreciated that the die 606 could be a multi cavity die for making multiple castings per cycle.

The die 606 includes a plurality of gas exit vents 680 that extend around the perimeter of the cavity 644 and they are configured to capture and hold exhaust gas as the metal 632 enters the cavity 644 and during the metal cooling and solidification process. The vents 680 may be spaced apart evenly and they also provide a volume of space for the inert gas 670 to escape into during the cooling and solidification process. In one of the dies 606, for example in the female die shown at 606A, the inert gas delivery flow path or passageway 674 is formed as a channel extending through one side 682 of the die 606A. The passageway 674 is part of the inert gas delivery control system 614 and it is operable to provide a supply of inert gas 670 to the cavity 644. It will be appreciated that a connector or coupler system 684 may be part of the inert gas delivery system 614. The connector system 684 may be provided on the side 682 of the die 606A to provide quick connection between the die 606 and the supply of inert gas. Alignment pins 686 and bores 688 may be provided around the perimeter of the die 606 so as to aid in closing die halves 606A and 606B.

With continued reference to FIG. 9, one or more sensors 654 may be provided within the cavity 644 and/or about the perimeter of the cavity 644. The sensors 654 may be of the type that detects solidification, temperature, or other characteristics, of metal 632 during the cooling process. One aspect of this disclosure is that it delivers inert gas 670 at various predetermined times of the casting process. Thus, the sensors 654 aid to tell the CPU 612 and/or the inert gas delivery system 614 the cooling state of the molten metal 632. For example, inert gas 670 can be delivered to the cavity 644 before metal is delivered to the cavity so as to "flush" the cavity 644 and other areas of the die 606. Such will aid in removing environmental contaminants from the die. Once the die is "flushed", then gas 670 continues to be delivered to the die 606 during the metal pouring process. Once the pouring process is complete, inert gas 670 continues to be delivered to the die 606 during the solidification process. Once the sensor 654 indicates a desired solidification state of a part, then the gas supply is turned off. Throughout the gas delivery process, the system may vary the rate of gas flow and pressure to the mold, and the system may automatically adjust said flow and pressure based on sensed conditions, material types, production demand, and/or other conditions.

Figure 10:
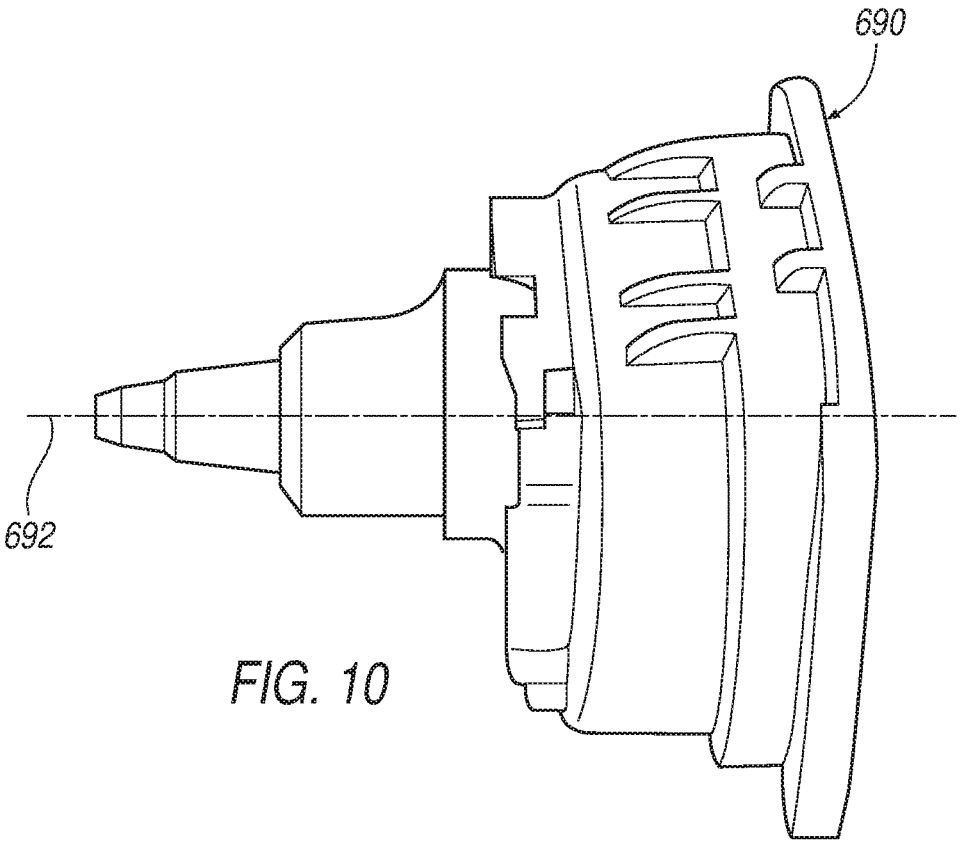
FIG. 10 is a perspective view of the cast part that could be manufactured in a foundry using the die shown in FIG. 9.
Figure 11:
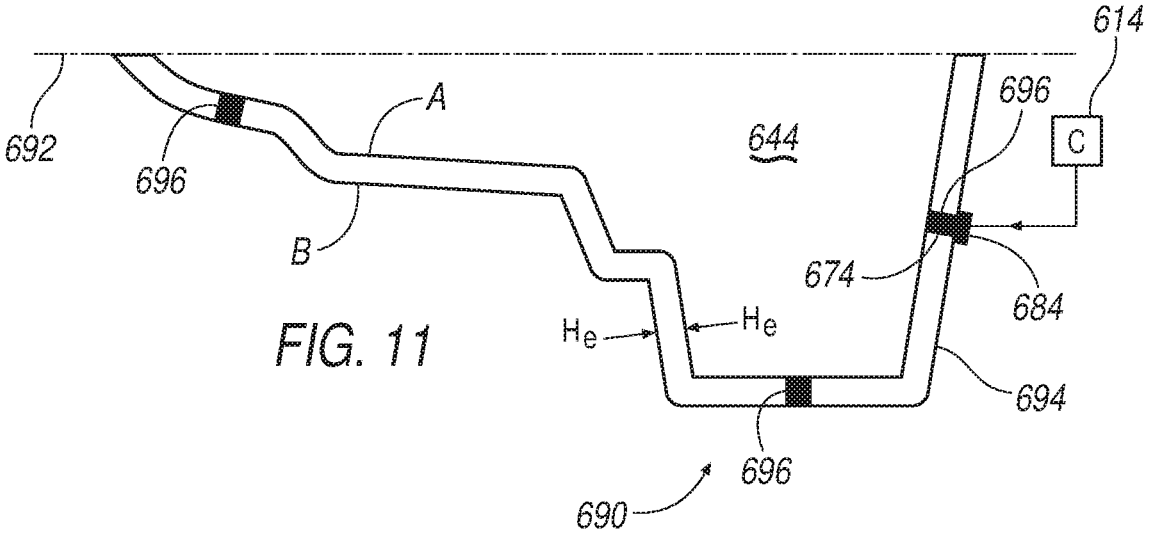
FIG. 11 is an enlarged side section cut of the cast part shown in FIG. 10, taken from the perspective of line 10-10, showing the construction of the part that is produced using the process shown in FIG. 8.

FIG. 10 is a perspective view of the part 690 that was cast using the die shown in FIG. 9. FIG. 11 is an enlarged side section cut taken from line 692 of FIG. 10, showing the construction of the part 690 that is produced using the process shown in FIG. 8. The casting 690 has a wall 694 with a thickness that surrounds the cavity 644. The wall 694 may include one or more vent plugs 696 that are disposed within the inert gas delivery path 674. Alternatively, the vent plugs 696 may be disposed in the wall 694 outside of the path 674. The plug 696 permits delivery of inert gas 670 so that it goes only one way, i.e., from the inert gas delivery and control system 614 into the cavity 644. The plug 696 prevents gas 670 from reversing its flow and escaping the die 606.

Inert gas 670 is delivered to both side A and side B of the part during certain portions of the casting process. Side A reflects an inside surface of wall 694, while Side B reflects an outside surface of wall 694. Thus, inert gas 670 impinges (as shown in the arrows) upon both sides A and B of the part 690 which aids enhancing the cooling and solidification rate of the part 690. Such action positively influences the Dendrite Arm Structure (DAS) of the resulting part 690. See the tables herein. Further, as the metal solidifies, it does so under gas pressure which forces the inert gas onto and into surfaces A and B of the wall 694. This enhances permeation of the gas into the wall 694 which further improves part characteristics. Thus, an improved casting 690 is provided that is cast using a method of applying pressurized inert gas to one or more surfaces of the inner and/or outer walls 694 of the casting 690.

It will be appreciated that the systems herein may apply inert gas pressure to just one side of the wall, or both sides of the wall, and that the system may also be modified to apply pressurized inert gas at different pressure levels to different surfaces (such as A and B). Further, a resulting casting may be produced deploying a process of impinging inert gas at different pressure levels to different sections of the part. Thus, if it is desired to have a resulting part that has different performance characteristics at different sections of the casting, then the system may be designed to deliver inert gas, at certain delivery rates, to certain sections of the mold, so as to enhance the desired outcome of the resulting casting. This method and process is called direct casting feature enhancement.

Figure 12A:
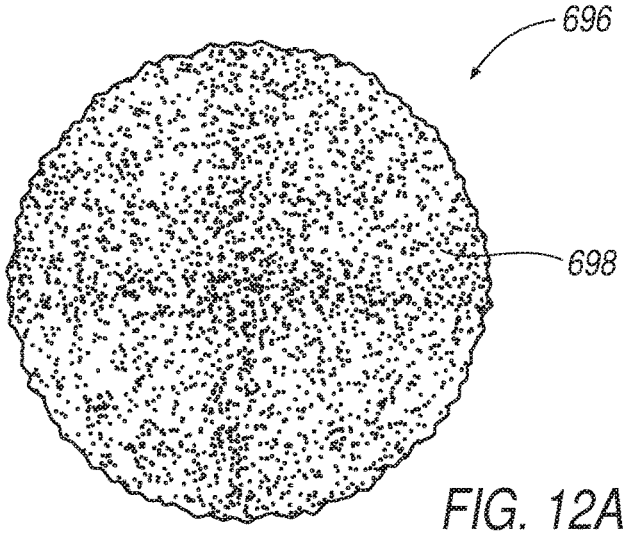
FIG. 12A is an illustration of a vent plug made of powdered metal that can be used with the mold shown in FIG. 10.
Figure 12B:
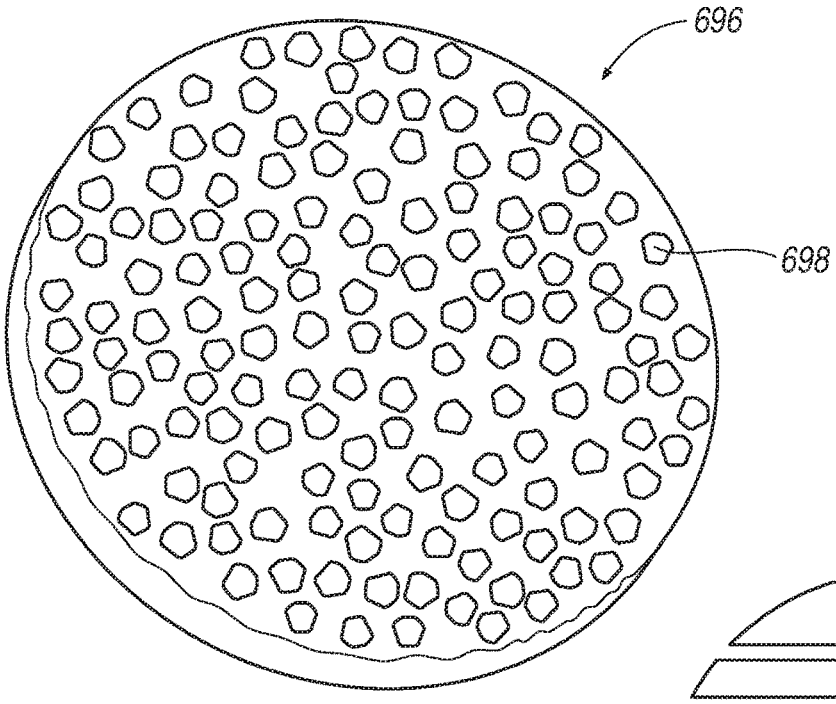
FIG. 12B is an illustration of an alternative vent plug.

FIG. 12A is a top view of an exemplary vent plug 696 that has a porous surface 698. The plug 696 may be a powder metal inert gas diffuser plug. The thickness of the plug may be equal or lesser than the thickness of the wall 694. FIG. 12B shows an alternative plug 696 that operates as a gas diffuser and it may have a porous surface 698 that has varying characteristics so as to provide a greater flow of inert gas therethrough as compared to the plug 696 in FIG. 13A. FIG. 13C illustrates a top view of yet another alternative diffuser plug 696, but this variant has a machined surface 700 with a series of offset form one another channels 702 extending in parallel relationship to one another. The machined surface 700 directs inert gas 670 to flow through the channels 702. More or less channels 702 may be provided based on desired gas flow rates. The surface 700 may be flat or contoured.

Figure 13:
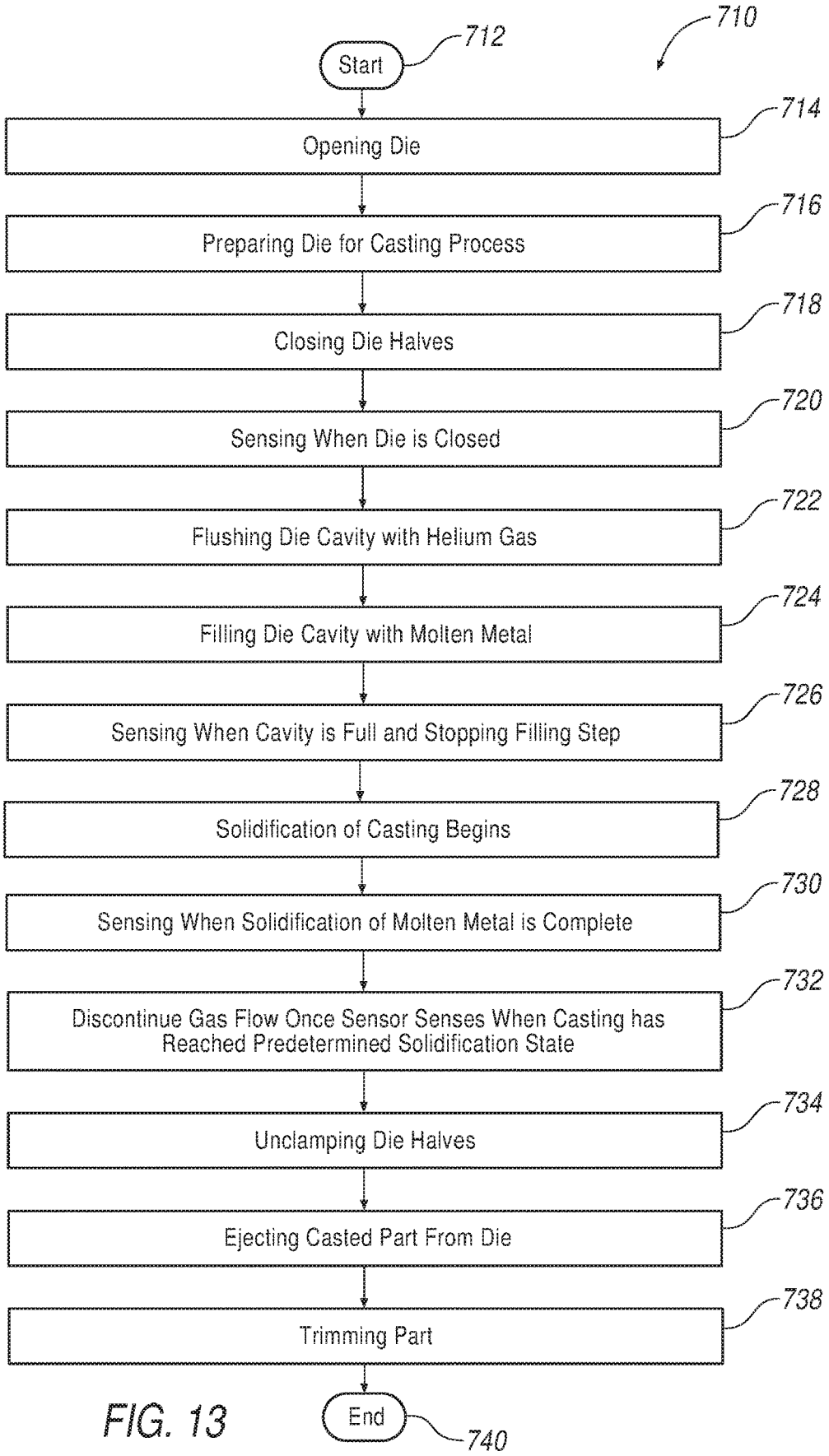
FIG. 13 is a flow chart of the method of operating the foundry die casting system that is shown in FIG. 8.

FIG. 13 is a flow chart of the method of operating 710 the foundry die casting system 600 that is shown in FIG. 8. The method 710 may include more or less steps than that set forth herein. For exemplary purposes, helium gas is discussed but other inert gasses may be contemplated. The method of operating 710 includes starting 712 with the step of opening 714 the die 606 and preparing 716 the die for a casting process. Preparing the die 716 for the casting process may include bringing it to a desired temperature, cleaning it and then lubricating it to enhance part extraction. The next step is to close 718 the die halves to prepare them for the closure during the casting process. Closing the die halves and clamping them is performed using high pressure system of the machine 610. A sensor senses when the die is closed 720 so that it can be sealed off for the metal pour process. This may be accomplished by using proximity sensors.

The next step is to flush 722 the die cavity with an inert gas such as Helium. The flushing step is performed with a gas at a flow rate, for example, of about 10 liters/minute for about 10 seconds. This step forces air and other contaminants out from the cavity of the die 606 and replaces them with desired inert gas.

Once the die cavity is flushed with an inert gas, the next process is to begin filling 724 the die cavity 644 with molten metal 632. During this metal fill process, the inert gas at a lower feed rate is continuously delivered to the cavity 644. This may be completed by transferring molten metal from the furnace into a ladle 640. The ladle pours molten metal into the shot chamber 630. The plunger 624 advances the molten metal which is in turn injected into the clamped cavity under high pressure. It will be appreciated that at the metal pouring step the inert gas continues to be delivered to the die cavity 644 but now at a slower feed rate of about 5 liters/minute. Thus, an inert gas delivery system is provided that is variable and selective.

The metal fill process 724 continues until a sensor senses when the cavity is full 726. Once the cavity is full the fill process 724 stops and the solidification 728 of the casting begins. During the casting solidification process inert gas continues to be delivered to the cavity 644. During the solidification step, a sensor senses 730 when solidification of the molten metal is complete. Once solidification has reached a predetermined state, the supply of inert gas is discontinued 732 to stop the flow of gas into the cavity 644. The casting is now cooled sufficiently to be removed from the die 606. This is accomplished by unclamping 734 the die halves 606A and 606B to permit ejecting 736 the part 690 from the die. Once the part 690 is ejected, the part is then trimmed 738. The part is now complete and the process 710 has ended 740.

Figure 14:
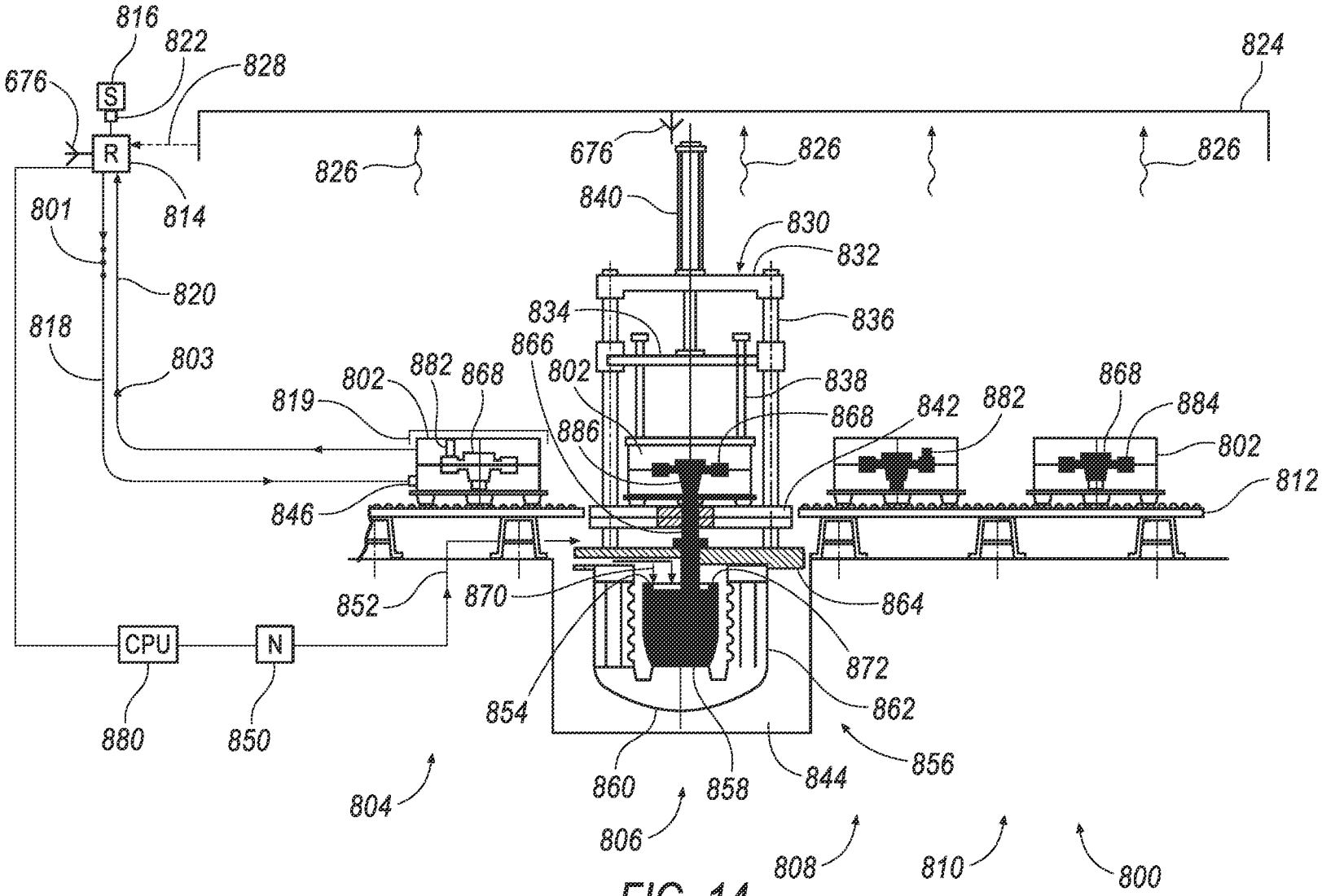
FIG. 14 is a schematic diagram of an alternative casting system, showing a permanent mold system that employs a low-pressure counter gravity fed permanent mold, illustrating the step of a mold cavity being filled while using an inert gas.

FIG. 14 is a schematic diagram of an alternative casting system, showing a permanent mold casting system 800 that employs a low-pressure counter gravity fed permanent mold 802, illustrating the step of a mold cavity being filled using an inert gas. The permanent mold casting system 800 may include a first station 804, a second station 806, a third station 808 and a fourth station 810. The first station 804 is a mold preparation stage where a mold is prepared for filling and an inert gas source is connected to the mold. The second station 804 is a low pressure counter gravity fed metal filling stage. The third station 806 is mold cooling stage where the inert gas source is disconnected from the mold. The fourth station 808 is where the part has solidified and is then ejected from the mold. The mold traverses on a conveyor system 812 that continuously indexes between said stations.

An inert gas recovery and supply system 814 provides a method of delivering to a mold 802 inert gas 801, and capturing inert gas, such as Helium, Argon and/or Nitrogen, that escapes from the mold 802 during the foundry process. The inert gas recovery and supply system 814 may include a supply source 816, a gas delivery member 818 with a disconnect 846 for communicating the supply of inert gas 801 to a mold 802. A reclaimer 819 captures inert gas 801 that escapes from the mold 802 during the foundry process as the mold 802 indexes from station 804 to station 808. A captured gas return line 820 returns captured gas 803 from the reclaimer 819 to the gas supply source 816. The gas supply source 816 may include a scrubber 822 for cleaning the returned supply of inert gas 803 before it enters the supply source 816. The captured inert gas 803 may be kept separate or may be comingled with a clean supply of inert gas 801.

The inert gas recovery and supply system 814 may include a hood 824 that covers one more stations of the casting system 800. The hood 824 is operable to capture from one or more stations the escaped inert gas 826, direct the captured gas via line 828 to a supply source 816. Thus, the casting system 800 may include a hood 824 or a single reclaimer 819 or a plurality of single reclaimers 819 disposed as various stations for aiding in recovering inert gas 801 that has escaped the foundry process. It will be appreciated that the escaped inert gas 826 may be recovered using other methods and hardware, all of which are contemplated by this disclosure.

The system 814 may be deployed with the other casting systems 10, 300, 600, that are set forth in this disclosure. The inert gas recovery and supply system 814 is operable to stay connected to the mold 802 as it indexes from station to station. The system may be provided with a disconnect 846 that communicates with the mold 802. The disconnect 846 allows the supply of inert gas to be removed from the supply source 816.

The permanent mold casting system 800 further includes a molding machine 830 that is positioned at station 806. The machine 830 includes a frame 832, a clamp 834, a slider 836, push pins 838, a ram 840, and a platform 842 that the mold 802 rests upon. The ram 840 exerts pressure on the clamp 834 which in turn maintains pressure on the mold 802 to keep it closed which is the position shown in FIG. 14.

The casting system 800 further includes a high pressure source 850 for delivering a gas such as Nitrogen via a delivery tube 852 to an inlet 854 of a furnace 856. The furnace 856 has a heater for maintaining molten metal 858 at a predetermined temperature. The furnace 856 includes a bottom wall 860, side wall 862, a furnace platform 864, and a metal delivery tube 866. The metal delivery tube 866 communicates with the mold 802 and provides a fluid flow of molten metal to a cavity 868 of the mold 802. During operation, pressurized Nitrogen flows through delivery tube 852 to supply downward pressure 870 on the upper surface of a vat 872 that is filled with the molten metal 858. This pressure causes an upward movement of molten metal to traverse upwardly within metal delivery tube 866 and then in turn into the cavity 868 of the mold 802. The high pressure source 850 is operable to be controlled by a CPU 880 which in turn is connected to the inert gas supply source 816, the machine 830, the furnace 856, and other systems of the casting system 800.

With continued reference to FIG. 14, once a part has been cast, it is removed from the machine 830 and traverses on the conveyor to the next station 808 where the solidification process continues. At station 808, inert gas 801 continues to be delivered to the mold 802 to aid in part solidification and dendrite arm structure (DAS) formation. The inert gas supply and recovery system 814 continues to monitor and deliver inert gas to the mold 802 during the solidification process. Sensors 882 may be deployed in and/or around the mold cavity 868 so as to aid in the determination of the solidification process of the new part 884. It will be appreciated that the inert gas and recovery system 814 is operable to simultaneously deliver and maintain the proper supply of inert gas 801 to the various stations (804, 806 and 808) while the casting system 800 is in operation.

Inert gas 801 is delivered to the mold 802 similar to the method and system that was discussed in the system 600, the discussion of which is hereby incorporated by reference. But generally, inert gas 801 is delivered to the cavity 868 via the gas delivery member 818, to the mold 802 via a disconnect 820, though a diffuser plug 696 (See FIGS. 12A-12), where a controlled supply of inert gas 801 can flush the cavity 868 and maintain a predetermined pressurized supply of gas to the mold 802 during the casting process.

Figure 15:
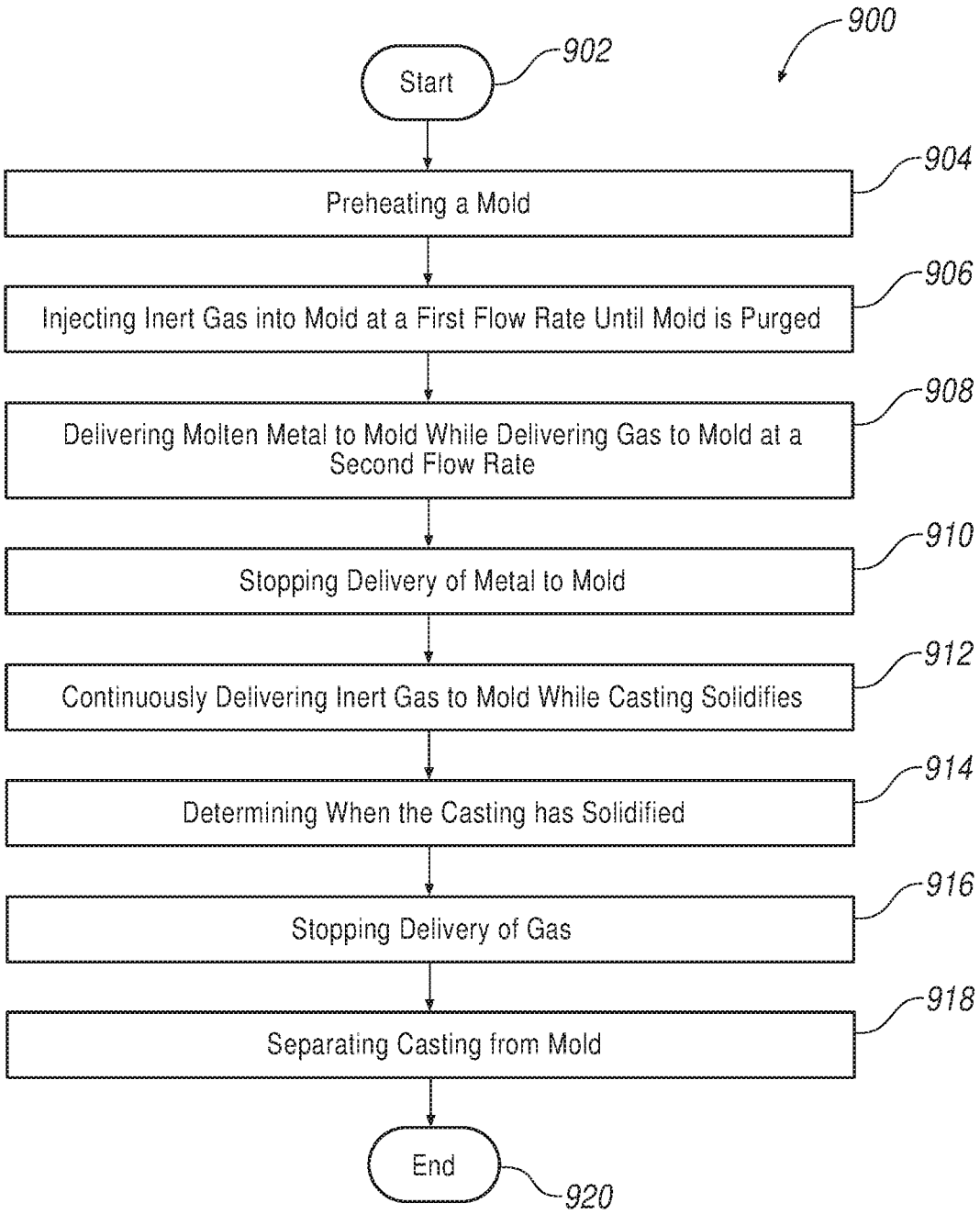
FIG. 15 is a flow chart of the method of operating the low pressure counter gravity fed permanent mold casting system that is shown in FIG. 14.

FIG. 15 is a flow chart of the method 900 of operating the low pressure counter gravity fed permanent mold casting system 800 that is shown in FIG. 14. The first step starts 902 the casting process by preparing the mold 802 by preheating 904 is and lubricating it so as to enhance remove of the part once the casting process is completed. This is performed at the first station 804. The next step is to inject 906 inert gas into the mold, 802 at a first flow rate until the mold is purged or flushed. It will be appreciated that the flow rate for flushing can be about 10 L/minute for a period of about 10 seconds. Once the mold 802 is flushed, the mold indexes to the fill station 806. The supply of inert gas may be disconnected or maintained during this indexing step.

The next step is to fill the mold by delivering 908 molten metal to the mold while delivering gas to the mold. The same gas flow rate or a different flow rate may be deployed during this mold fill step. Sensors may be deployed so as to monitor the level of inert gas within and/or around the cavity 868 so as to assure pressurized inert gas maintains the area within the cavity, and not contaminated environment gases. If the sensor senses contaminated environment gases, then the system 816 may increase pressure and force more inert gas within the cavity of the mold. Once the level inert gas within the cavity 868 is at a predetermined level, then the system 816 may automatically reduce the feed rate of inert gas. Mold fill sensor(s) 886 may be located within or about the cavity 868 so as to sense when the mold if full of molten metal. When this situation occurs, the mold is full and the pour process can be terminated.

Then next step is to stop delivery 910 of metal to the mold. When this occurs, the Nitrogen supply source 850 stops applying pressure to Nitrogen supply line 866 so that the metal stops traversing upwardly in the metal delivery tube 866. Once the fill process stops, the mold 802 exits the machine 830 and indexes to the third station 808 where cooling of the part continues. During the cooling phase, the system continues 912 to deliver inert gas to the mold to aid in solidification. A solidification sensor 882 monitors the solidification status of the part 884 to determine 914 when the casting has solidified. Once the sensor 882 has determined with the casting has solidified to a desired level, the system stops 916 delivering inert gas to the mold 802. The final step is to index the mold 802 to the fourth station 810 and then separate 918 the part 884 from the mold. The process 900 in now ended 920 and the process can be repeated.

Figure 16:
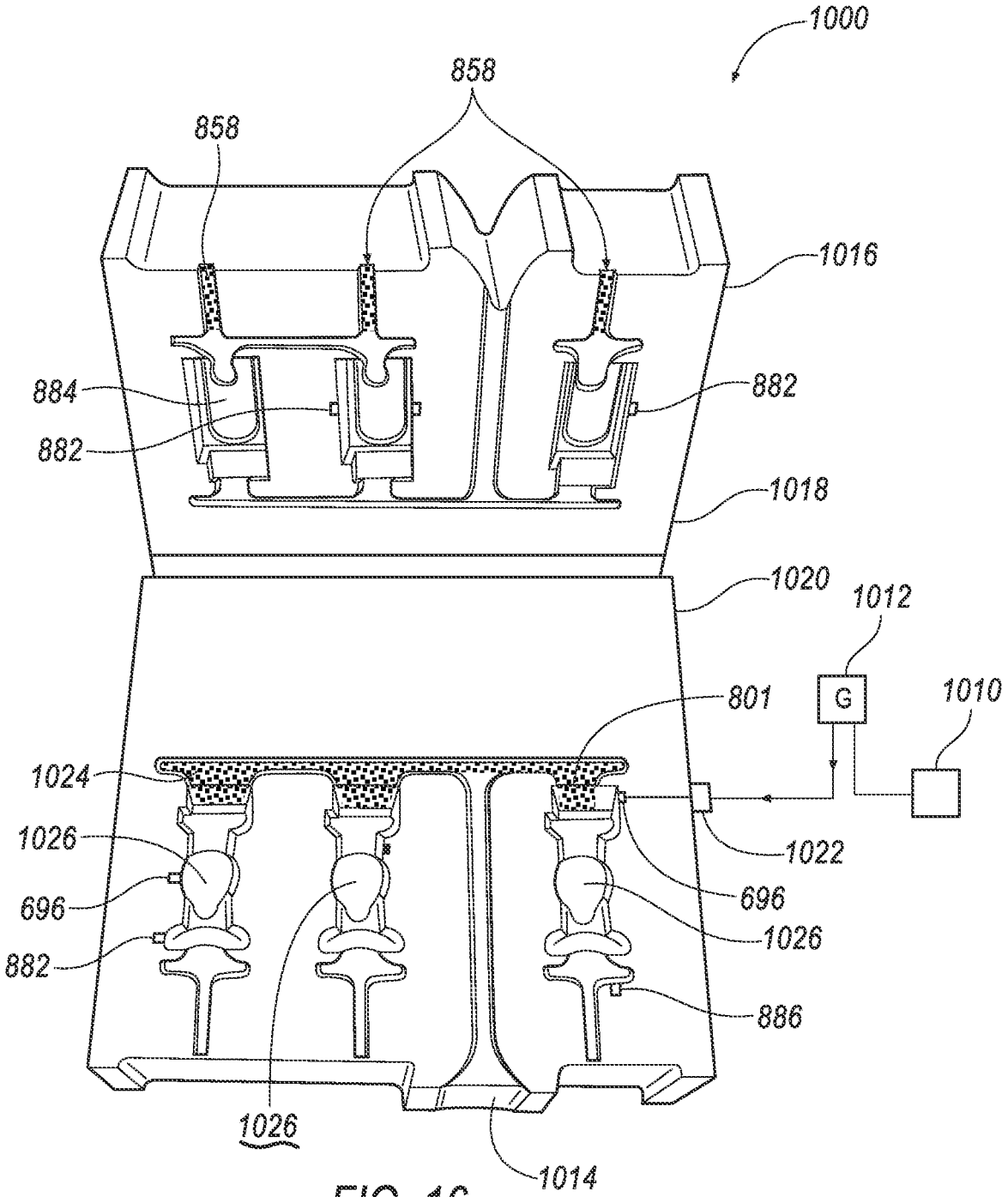
FIG. 16 is an alternative mold that is used in permanent mold casting system, showing a gravity fed permanent mold that has an inert gas supply and venting arrangement.

FIG. 16 illustrates an alternative mold 1000 that may be used with a low-pressure gravity fed permanent mold system 1010, wherein an inert gas supply 1012, and venting system 1014 is provided to aid the solidification process of a part. The mold 1000 is used in a gravity fed system which is different than the counter gravity fed permanent mold system 800 that was discussed in FIGS. 8-15. This gravity fed mold 1000 is used with mold system 1010 somewhat similar to the mold system 800 and has a furnace and other similar components which will not be repeated. A difference though is that the molten metal 858 is poured from the top 1016 of the mold 1000. The mold 1000 has a first die or mold halve 1018 and a second die or mold halve 1020. The two halves work in concert when they are closed using a machine 830 similar to that shown in FIG. 14. A difference though is that the pouring system delivers molten metal 858 from the top 1016 of the mold instead of the bottom of the mold. Thus the machine 830 is modified to accommodate delivery of molten metal to the top 1016 of the mold 1000.

The mold 1000 is connected to the supply of inert gas 1012 by a connector 1022. A gas delivery passage 1024 extends within the mold halve 1020 or the mold halve 1018, or both, in order to deliver a supply of pressurized inert gas 801 to the lower portion of the mold cavity 1024. This arrangement forces contaminants upward and out of the cavities 1026 via the venting system 1014. An inert gas supply path extends from a lateral side of one of the die halves 1018, 1020. Gas 801 is delivered via the path to flush the die halves and it continues to be delivered while metal is delivered to the die halves. The mold 1000 may have more than one cavity, and for exemplary purposes only, mold 1000 illustrates 3 cavities 1026 which allows the foundry to cast three parts per cycle while deploying the inert gas 801 process of flushing the cavities, filing the cavities 1026 with molten metal, and then solidifying the parts. This arrangement allows for a reduction in casting cycle times yet all the while producing castings that have improved Dendrite Arm Structures (DAS).

Figure 12C:
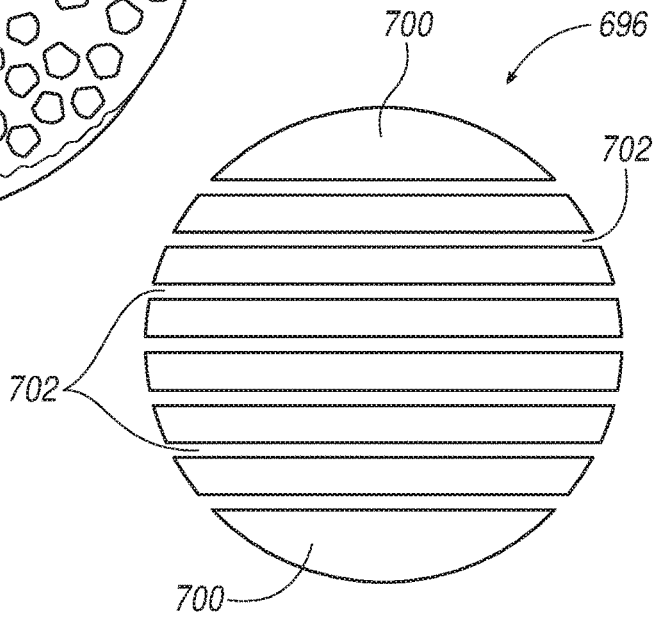
FIG. 12C is an illustration of a machined vent plug.

The mold 1000 may also deploy vent plugs 696 (as shown in FIGS. 12A, 12B and 12C) which aid in trapping inert gas 801 within the cavities 1026 and keeping out environmental contaminants. Sensors 882 may be placed about the mold 1000 to provide data on the performance of the molding performance, such as, but not limited to, if a cast part is solidified, cooled, molten, etc.

Figure 17:
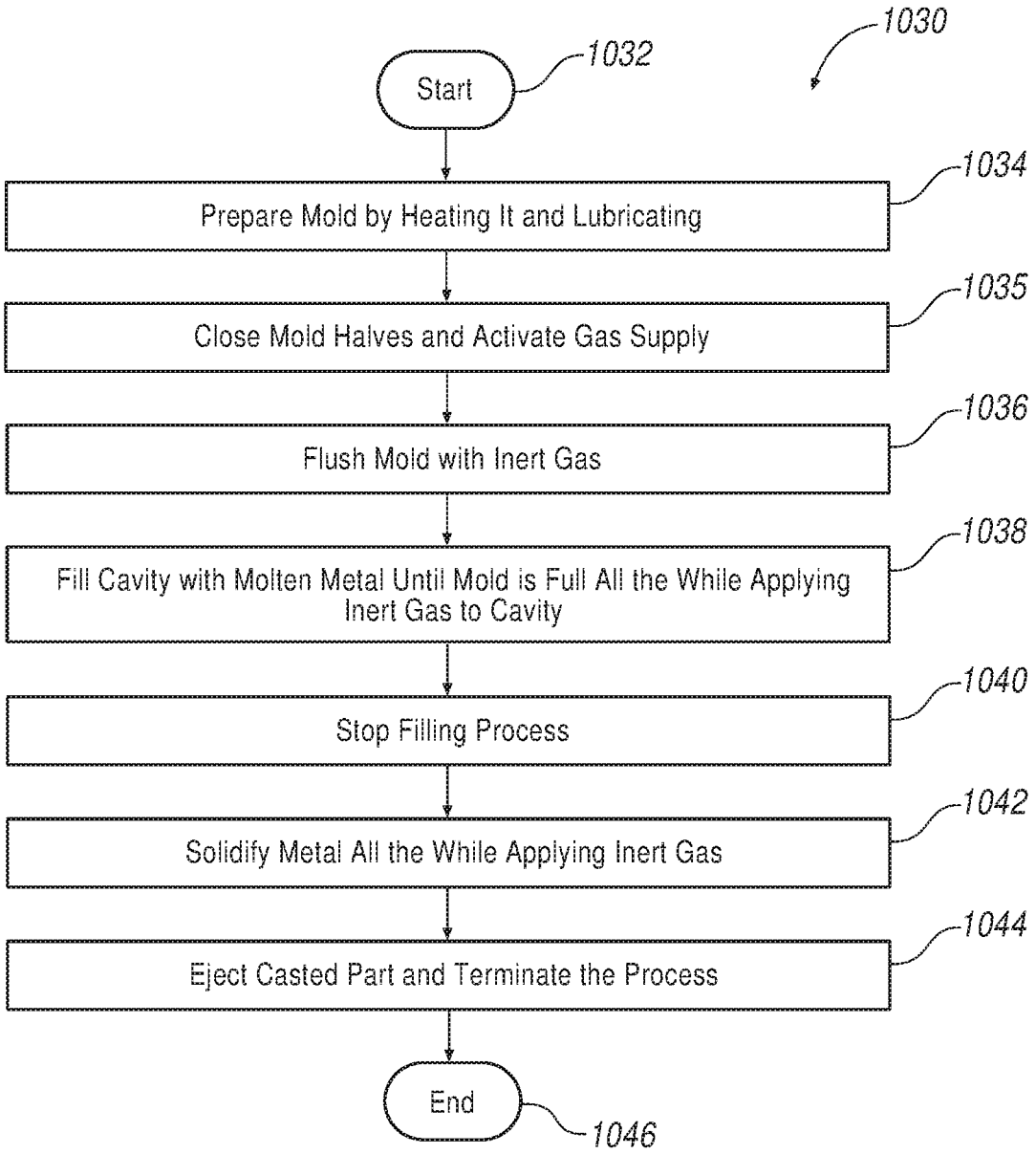
FIG. 17 is a flow chart of the method of filling the gravity fed permanent mold die that is shown in FIG. 16.

With reference to FIG. 17, a method of operating 1030 a low-pressure gravity fed permanent mold system 1010 of FIG. 16 is illustrated. The first step is to start 1032 the molding process. The next step is to prepare 1034 the mold by heating it and lubricating it so that the part can be easily removed. The next step is to close 1035 the mold halves 1018 and 1020 and activate the gas supply 1012 to flush 1036 the mold with an inert gas 801. Once the mold cavity is flushed, the inert gas 801 is continued to be fed to the cavities 1026 while the metal fill 1038 process begins. The metal filing process 1038 continues until a mold full indictor signal is sensed by a sensor 886. The inert gas continues to be applied during this process and continues to permeate the walls of the cavities 1026. At this point the mold is full of metal and the pouring process stops 1040. During the fill process 1038 the venting system 1014 provides a path for gases to escape the cavities 1026. This is aided by the continued positive pressure of inert gas 801 being exerted in the bottom of the mold 1000. It will be appreciated that the inert gas supply and recovery system 814 discussed above may be deployed with the permanent mold system 1010.

The next step is the solidification process 1042 and during this process positive inert gas pressure continues to be deployed on the mold 1000 from supply 1012. A metal solidification sensor 822 may be provided in a plurality of locations about the mold 1000 and once they indicate the casting has solidified to a certain state, then the gas supply 1012 is turned off and the part is then cooled sufficiently to then be removed from the mold. The next step is to eject 1044 the part 884 from the mold 1000 and the process can stop 1046. The process 1030 can now be repeated and the mold 1000 can be reused to cast new parts. Thus, this method is intended to be used for high and low production volume permanent mold operations.

Figure 18:
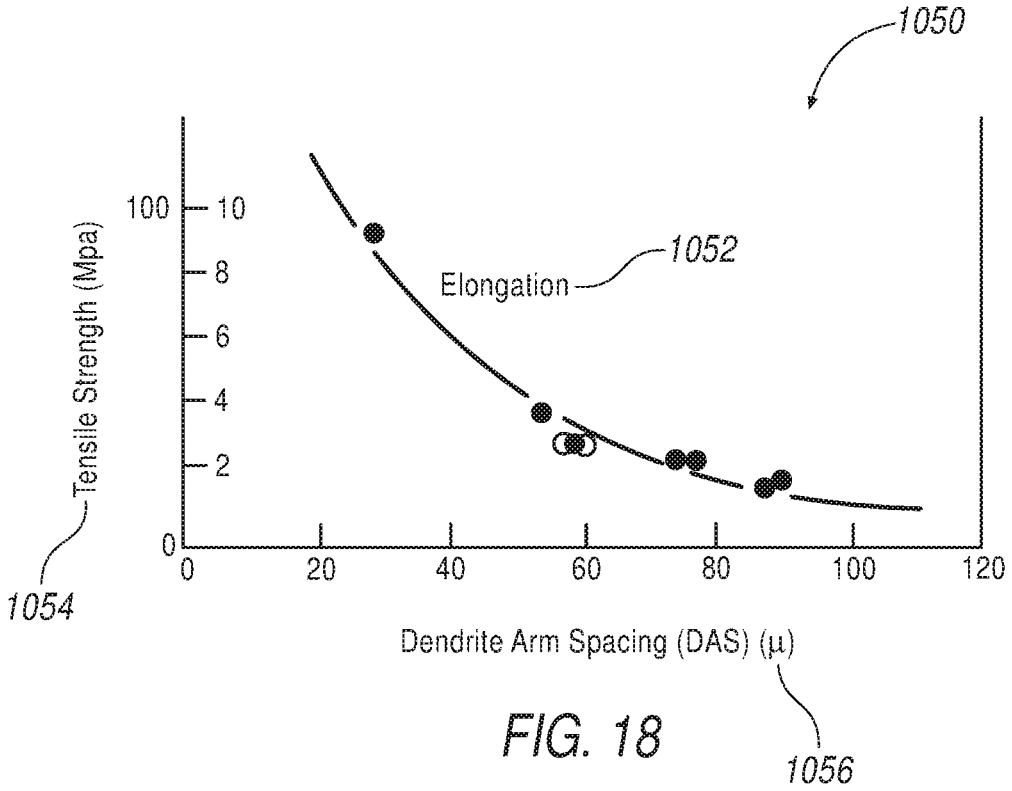
FIG. 18 is a graph showing the material properties of a casting, where percent of elongation is shown as a measure of tensile strength vs. Dendrite Arm Spacing (DAS)

FIG. 18 is a graph 1050 showing the material properties of a casting, where percent of elongation 1052 is shown as a measure of tensile strength 1054 vs. Dendrite Arm Spacing (DAS) 1056. An inverse correlation exists between DAS 1056 and tensile strength 1054. Likewise, an inverse correlation exists between DAS and elongation 1050. Cast parts with lower DAS values are desirable as they have higher metallurgical properties. Cast parts using the inert gas systems and methods discussed herein have generally shown lower DAS values. DAS is a metallurgical characteristic that is dependent on molten metal cooling rates and influences the ductility [Elongation] of the aluminum most significantly as shown in FIG. 18. The data base for metal/material properties existing in handbooks up until now was entirely developed over the years under atmospheric conditions [Nitrogen & Oxygen] and thus influenced by their physical characteristics during solidification. However, Helium gas is an inert and very low density gas with extremely high conductivity operates to positively change the property characteristics that are influenced by cooling rates while solidifying.

FIG. 19 is a chart 1075 showing performance results of a sand mold aluminum casting trial where two castings having been cooled by conventional air have been compared to two castings having been cooled by an inert gas such as Helium. The graph represents improved Dendrite Arm Spacings, cooling rates, and percent of elongation of castings when Helium gas has been deployed during the foundry process.

FIG. 20 is a chart 1080 showing performance results of a permanent mold casting trial using water cooled molds, wherein Dendrite Arm Spacing is shown to positively influence the volume percent of porosity of a casting compared to thermal fatigue life of a casting. In general, the trial revealed that thermal fatigue life cycles of a casting increase measurably with the reduction of DAS and mico-porosity. Likewise, as DAS reduces, so does volume percent of porosity. The disclosed systems 10, 600, 800, and 1000 employ an improved casting process that deploys inert gas during the casting process such that the resulting casting has improved DAS characteristics. Such casting processes can be deployed for prototype runs as well as high volume production operations.

It will be appreciated that the aforementioned method and systems may be modified to have some components and steps removed, or may have additional components and steps added, all of which are deemed to be within the spirit of the present disclosure. Even though the present disclosure has been described in detail with reference to specific embodiments, it will be appreciated that the various modifications and changes can be made to these embodiments without departing from the scope of the present disclosure as set forth in the claims. The specification and the drawings are to be regarded as an illustrative thought instead of merely restrictive thought.

What is claimed is:

1. A die casting system comprising:

a die having a first portion and a second portion;

a metal delivery system that is operable to deliver molten metal to the die; and an inert gas system that is operable to be connected to at least one of the die and machine, the inert gas system includes a controller configured to pressurize the die and flush the die with inert gas before metal is delivered to the die, and is configured to continuously deliver pressurized inert gas to the die during a mold fill cycle or a cure cycle.

2. The die casting system of claim 1, wherein the casting system is one of a high pressure casting system, a low-pressure casting system.

3. The die casting system of claim 1, wherein the casting system is one of permanent mold, semi-permanent mold.

4. The die casting system of claim 1, further comprising a gas vent.

5. The die casting system of claim 1, further comprising a system that pressurizes the cavity of the die against gravity.

6. The die casting system of claim 1, further comprising at least one of a mold fill sensor, a metal solidification sensor.

7. The die casting system of claim 1, further comprising an ejector, the ejector is operable to remove a part that is cast within the die.

8. The die casting system of claim 1, further comprising an exhaust gas vent positioned relative to the die.

9. The die casting system of claim 1, further comprising a sensor that senses a gas parameter while gas exits the die.

10. The die casting system of claim 1, further comprising at least one mold fill sensor for sensing when a die has been filled with molten metal to a predetermined level.

11. The die casting system of claim 1, wherein the gas system is configured to manage the flow of inert gas from a gas source by selectively turning the flow of inert gas on or off up until when a casted part is cooled.

12. The die casting system of claim 1, wherein the inert gas system delivers at least one of Helium, Argon, Nitrogen.

13. The die casting system of claim 1, further comprising a fluid passageway extending from an outside surface of the die, to an inside cavity of the die, the fluid passageway is configured to continuously deliver inert gas to permeate the inside cavity of the die during a casting cycle.

14. A die cast tool comprising:

a first die half;

a second die half; and an inert gas supply path that extends from a lateral side of one of the die halves, inert gas is configured to be delivered in the path to flush the die halves and continues to be delivered while metal is delivered to the die halves, the gas supply path is for delivering or removing gas from a cavity of at least one of the dies halves.

15. The casting system as claimed in claim 14, further comprising an inert gas delivery system that controls volume and flow rate of inert gas to the die halves.

16. The casting system of claim 14, wherein the inert gas is at least one of Helium, Argon, Nitrogen.

17. The casting system of claim 14, further comprising a gas system that is configured to manage a flow of inert gas from a gas source by turning the flow of inert gas off when a casted part is cooled.

18. A casting system comprising:

a die;

a machine that is configured to receive the die and secure it in place during a casting operation;

a metal delivery system that is configured to deliver molten metal to the die;

an inert gas source that is operable to be connected to at least one of the die and the machine, the inert gas source is configured to deliver a pressurized supply of inert gas to the die before and while the die is being filled with molten metal; and an assembly line that is operable to deliver the die to an inlet side of the machine, and then exit the die from an outlet side of the machine.

19. The casting system as claimed in claim 18, wherein the inert gas source is configured to provide one of Helium, Argon, Nitrogen.

20. The casting system of claim 19, further comprising at least one of a mold fill sensor, a metal solidification sensor, a sensor that senses a gas parameter while gas exits the die, a gas vent, or an ejector, the ejector is operable to remove a part that is cast within the die.

* * * * *